US009238162B2

(12) United States Patent
Breier et al.

(10) Patent No.: US 9,238,162 B2
(45) Date of Patent: Jan. 19, 2016

(54) GOLF CLUB WITH ADJUSTABLE WEIGHT ASSEMBLY

(71) Applicant: Cobra Golf Incorporated, Carlsbad, CA (US)

(72) Inventors: Joshua G. Breier, Vista, CA (US); Andrew Curtis, San Diego, CA (US); Oswaldo Gonzalez, San Jacinto, CA (US); Scott H. Moreira, San Diego, CA (US); Douglas E. Roberts, Carlsbad, CA (US); Ryan L. Roach, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 0 days.

(21) Appl. No.: 14/261,968

(22) Filed: Apr. 25, 2014

(65) Prior Publication Data

US 2015/0306473 A1 Oct. 29, 2015

(51) Int. Cl.

| | |
|---|---|
| ***A63B 53/06*** | (2015.01) |
| ***A63B 53/04*** | (2015.01) |
| ***A63B 59/00*** | (2015.01) |

(52) U.S. Cl.

CPC ..... *A63B 53/06* (2013.01); *A63B 53/0466* (2013.01); *A63B 59/0074* (2013.01); *A63B 2053/0433* (2013.01); *A63B 2053/0491* (2013.01)

(58) Field of Classification Search

CPC ..... A63B 2053/0491; A63B 2053/0433
USPC ..... 473/334, 335, 337, 338, 344
See application file for complete search history.

(56) References Cited

U.S. PATENT DOCUMENTS

| | | | |
|---|---|---|---|
| 2,098,445 | A | 11/1937 | Wettlaufer |
| 2,171,383 | A | 8/1939 | Wettlaufer |
| 2,460,445 | A | 2/1949 | Bigler |
| 2,750,194 | A | 6/1956 | Clark |
| 3,199,874 | A | 8/1965 | Biasing |
| 3,556,533 | A | 1/1971 | Hollis |
| 3,610,630 | A | 10/1971 | Glover |
| 3,652,094 | A | 3/1972 | Glover |
| 3,976,299 | A | 8/1976 | Lawrence et al. |
| 3,979,122 | A | 9/1976 | Belmont |
| 3,979,123 | A | 9/1976 | Belmont |
| 4,895,371 | A | 1/1990 | Bushner |
| 5,252,869 | A | 10/1993 | Gordin |
| 5,316,305 | A | 5/1994 | McCabe |
| 5,676,606 | A | 10/1997 | Schaeffer et al. |

(Continued)

FOREIGN PATENT DOCUMENTS

| | | | |
|---|---|---|---|
| JP | 2760723 | B2 | 6/1998 |
| JP | 2006-320493 | A | 11/2006 |

*Primary Examiner* — Benjamin Layno
(74) *Attorney, Agent, or Firm* — Brown Rudnick, LLP; Mark S. Leonardo

(57) ABSTRACT

The invention generally relates to golf clubs with adjustable mass properties. In certain aspects, the invention provides methods and mechanisms for adjusting a club head center of gravity and/or moment of inertia by way of an adjustable weight assembly positionable along the sole of the club head body. When in a first position, the weight assembly provides a lower center of gravity so as to increase launch angle and reduce spin rate, resulting in greater overall distance of ball flight. When in a second position, the weight assembly provides a greater mass moment of inertia, which effectively enlarges the sweet spot and produces a more forgiving club for off-center hits.

11 Claims, 24 Drawing Sheets

(56) References Cited

U.S. PATENT DOCUMENTS 5,688,189 A 11/1997 Bland
5,720,674 A 2/1998 Galy
5,735,754 A 4/1998 Antonious
5,769,737 A 6/1998 Holladay et al.
5,788,584 A 8/1998 Parente et al.
5,916,042 A 6/1999 Reimers
5,967,905 A 10/1999 Nakahara et al.
5,971,867 A 10/1999 Galy
6,015,354 A 1/2000 Ahn et al.
6,056,649 A 5/2000 Imai
6,089,994 A 7/2000 Sun
6,123,627 A 9/2000 Antonious
6,217,461 B1 4/2001 Galy
6,248,025 B1 6/2001 Murphy et al.
6,277,032 B1 * 8/2001 Smith ..... 473/336
6,332,848 B1 12/2001 Long et al.
6,458,044 B1 10/2002 Vincent et al.
6,773,360 B2 8/2004 Willett et al.
6,890,267 B2 5/2005 Mahaffey et al.
6,994,637 B2 2/2006 Murphy et al.
7,059,973 B2 6/2006 Erickson et al.
7,125,344 B2 10/2006 Hocknell et al.
7,128,664 B2 10/2006 Onoda et al.
7,147,573 B2 12/2006 DiMarco
7,153,220 B2 12/2006 Lo
7,166,040 B2 1/2007 Hoffman et al.
7,166,041 B2 1/2007 Evans
7,186,190 B1 3/2007 Beach et al.
7,189,165 B2 3/2007 Yamamoto
7,201,669 B2 4/2007 Stites et al.
7,223,180 B2 5/2007 Willett et al.
7,351,163 B2 4/2008 Shimazaki et al.
7,407,447 B2 8/2008 Beach et al.
7,410,425 B2 8/2008 Willett et al.
7,410,426 B2 8/2008 Willett et al.
7,419,441 B2 9/2008 Hoffman et al.
7,448,963 B2 11/2008 Beach et al.
7,452,285 B2 11/2008 Chao et al.
7,452,286 B2 11/2008 Lin et al.
7,455,600 B2 11/2008 Imamoto et al.
7,462,110 B2 12/2008 Yamamoto
7,520,820 B2 4/2009 Dimarco
7,530,904 B2 5/2009 Beach et al.
7,540,811 B2 6/2009 Beach et al.
7,568,985 B2 8/2009 Beach et al.
7,572,194 B2 8/2009 Yamamoto
7,578,753 B2 8/2009 Beach et al.
7,591,738 B2 9/2009 Beach et al.
7,611,424 B2 11/2009 Nagai et al.
7,611,425 B2 11/2009 Yeh
7,621,823 B2 11/2009 Beach et al.
7,632,194 B2 12/2009 Beach et al.
7,637,823 B2 12/2009 Shimazaki et al.
7,670,235 B2 3/2010 Lo
7,717,804 B2 5/2010 Beach et al.
7,717,805 B2 5/2010 Beach et al.
7,771,290 B2 8/2010 Bezilla et al.
7,771,291 B1 8/2010 Willett et al.
7,775,905 B2 8/2010 Beach et al.
7,806,782 B2 10/2010 Stites et al.
7,963,861 B2 6/2011 Beach et al.
8,016,694 B2 9/2011 Llewellyn et al.
8,066,584 B2 11/2011 Stites et al.
8,177,661 B2 5/2012 Beach et al.
8,192,303 B2 6/2012 Ban
8,206,243 B2 6/2012 Stites
8,216,087 B2 7/2012 Breier et al.
8,235,843 B1 8/2012 Rice et al.
8,262,507 B1 9/2012 Willett et al.
8,298,096 B2 10/2012 Stites et al.
8,425,348 B2 4/2013 Boyd et al.
8,444,505 B2 5/2013 Beach et al.
8,496,541 B2 7/2013 Beach et al.
8,562,457 B2 10/2013 Beach et al.
8,579,725 B1 11/2013 Willett et al.
2005/0181884 A1 8/2005 Beach et al.
2006/0122004 A1 * 6/2006 Chen et al. ..... 473/335
2006/0240907 A1 10/2006 Latiri
2006/0240908 A1 10/2006 Adams et al.
2007/0105646 A1 5/2007 Beach et al.
2007/0105648 A1 5/2007 Beach et al.
2007/0105654 A1 5/2007 Beach et al.
2007/0149315 A1 6/2007 Bennett et al.
2007/0249432 A1 10/2007 Wu
2008/0261715 A1 10/2008 Carter
2008/0261717 A1 10/2008 Hoffman et al.
2010/0048321 A1 2/2010 Beach et al.
2010/0075773 A1 3/2010 Casati, Jr.
2010/0075774 A1 * 3/2010 Ban ..... 473/336
2010/0331103 A1 12/2010 Takahashi et al.
2012/0058838 A1 3/2012 Stites et al.
2013/0005502 A1 1/2013 Ferguson et al.
2013/0090185 A1 4/2013 Boyd et al.
2013/0150176 A1 6/2013 Takechi
2013/0165255 A1 6/2013 Bezilla et al.
2013/0190100 A1 7/2013 Oldknow et al.
2013/0190104 A1 7/2013 Boyd et al.
2013/0244808 A1 9/2013 Bennett et al.
2013/0260913 A1 10/2013 Beach et al.
2013/0267338 A1 10/2013 Boyd et al.
2013/0303304 A1 11/2013 Sato
2014/0038746 A1 2/2014 Beach et al.
2014/0057739 A1 2/2014 Stites et al.
2014/0080629 A1 3/2014 Sargent et al.

* cited by examiner

GOLF CLUB WITH ADJUSTABLE WEIGHT ASSEMBLY

FIELD OF THE INVENTION

The present disclosure generally relates to golf clubs with adjustable mass properties.

BACKGROUND

Golfers at all skill levels seek to improve their performance, lower their golf scores, and reach that next performance "level." Manufacturers of all types of golf equipment attempt to respond to these demands by changing the golf equipment. The performance of a golf club can vary based on several factors, including weight distribution about the head, which generally affects the location of the center of gravity of the golf club head, as well as the mass moment of inertia.

Club designers and manufacturers often look for new ways to redistribute weight associated with a golf club and/or golf club head. For instance, club designers are often looking to distribute weight to provide more forgiveness in a club head, improved accuracy, better spin control, or to provide a particular golf ball trajectory and the like. Various approaches have been implemented for positioning discretionary mass about a golf club head.

To achieve significant localized mass, weights formed of high-density materials have been attached to the sole, skirt, and other parts of a club head. With these types of weights, the method of installation is critical because the club head endures significant loads at impact with a golf ball, which can dislodge the weight. Thus, in some examples, these weights may be permanently attached to the club head and are limited in total mass, which, of course, permanently fixes the club head's center of gravity. In other instances, individual weights are secured to the club head by way of fasteners (e.g., screws, bolts, etc.). For example, U.S. Pub. 2013/0303304 to Sato shows a golf club head having a number of threaded ports in the sole into which weighted elements may be screwed. U.S. Pub. 2013/0165255 to Bezilla et al. shows a golf club head having a weight mounting portion defined on a perimeter of the sole to which a weight member is secured via a fastener.

Although current designs allow a golfer to manipulate the mass characteristics of a golf club, there are numerous drawbacks. For example, rearrangement of one or more weights on a club head may be a time consuming process, as a golfer must fully unscrew and remove a weight in order to reposition the weight to a desired location. Furthermore, once fully removed from the club head during repositioning, weights may be lost or misplaced. Additionally, a golfer may not fully appreciate or understand various weight combinations and/or placement and their effects on performance characteristics of the club head, thus leading to unexpected performance of the club (e.g., more/less than desired spin, higher/lower than desired trajectory, more/less than desired distance, etc.) and possible frustration during play.

SUMMARY

The present invention provides a golf club head with adjustable mass properties. More specifically, the present invention provides a solution to the problems of weighting in golf club heads that allows for greater flexibility in modifying the center of gravity, mass moment of inertia, and/or swingweight of a golf club. The present invention is able to accomplish this by providing an adjustable weight assembly adapted to move to different positions along a length of the sole of the club head body, while remaining coupled to the club head at all times during positioning of the weight. The mass distribution of the golf club head can be changed based on different positions of the weight assembly. For example, when in a first position, in which the weight is closer to a front portion of the club head body, the weight assembly provides a lower center of gravity so as to increase launch angle and reduce spin rate, resulting in greater distance of ball flight. When in a second position, in which the weight assembly is closer to a rear portion of the club head body, the weight assembly provides a greater mass moment of inertia, which effectively enlarges the sweet spot and produces a more forgiving club for off-center hits.

Accordingly, the present invention provides a golfer with a mechanism to easily and quickly adjust mass distribution properties of the club head to the golfer's specifications. For example, if the golfer would like to correct a hook or a slice, the golfer need only move the weight assembly to the corresponding second position, which effectively increases the golf club head's moment of inertia about a vertical axis (e.g., moving mass out towards the rear of the club head to increase moment of inertia about a vertical axis), which translates to a greater ability to resist twisting during off-center ball impacts and less of a distance penalty for those off-center ball impacts. If the golfer would like to obtain a greater distance on their shot, they need only reposition the weight assembly to the corresponding first position, which effectively lowers the center of gravity, while sacrificing a degree of the golf club head's moment of inertia.

Since mass distribution of a club head can be adjusted, a golfer can have a golf club that is personalized to their playing style. Furthermore, since the weight assembly remains coupled to the club head at all times during positioning of the weight, the weight assembly does not require complete detachment from the club head for movement between positions, thus preventing the opportunity for misplacement or loss of the weight assembly. Additionally, the golf club head body may include indicia representative the performance characteristics (e.g., distance, accuracy, etc.) associated the positioning of the weight assembly, thus providing a golfer with a clear indication of the performance of the club.

In certain aspects, the invention provides a golf club head having a club head body that includes a front portion, a rear portion, a ball-striking face at the front portion of the club head body, a heel, a toe, a crown, and a sole. The sole has a track formed along a length thereof and defines a first end and an opposing second end adjacent to the front and rear portions of the club head body, respectively. The golf club head further includes a weight assembly coupled to the sole by way of a mechanical fastener. The weight assembly is adapted to move along a length of the track between at least a first position and a second position along the sole. When in the first position, the weight assembly is received within and secured to the first end of the track. When in the second position, the weight assembly is received within and secured to the second end of the track.

In some embodiments, the track includes a channel extending from an exterior surface of the sole towards an internal cavity of the club head body and lies along a plane that extends generally from the sole to the crown of the club head body. The channel has a groove formed therein extending along length of the channel and the groove lies along a plane that extends generally from the heel to the toe of the club head body. In some embodiments, the weight assembly is coupled to the sole by way of a an externally threaded headed fastener extending through a portion of the weight assembly, into the channel, and engaging an internally threaded retaining member slidably positioned and retained within the groove of the channel.

In some embodiments, when the weight assembly is in the first position, the golf club head has a center of gravity that is lower than when the weight assembly is in the second position and when the weight assembly is in the second position, the golf club head has a moment of inertia that is greater than when the weight assembly is in the first position.

In certain aspects, the invention provides a golf club head having a club head body including a front portion, a rear portion, a ball-striking face, a heel, a toe, a crown, and a sole. The golf club head further includes a track formed along a length of the sole that defines a first end and an opposing second end adjacent to the front and rear portions of the club head body, respectively. The track includes a channel extending from an exterior surface of the sole towards an internal cavity of the club head body and a groove formed within and extending along length of the channel and having a square internally threaded nut retained within.

The club head body further includes a weight assembly coupled to the sole by a bolt extending through a bore of the weight assembly, into the channel, and engaging the nut retained within the groove. The weight assembly is adapted to move along a length of the track between at least a first position and a second position. When in the first position, the weight assembly is received within the first end of the track and secured against a support surface of the first end. When in the second position, the weight assembly is received within the second end of the track and secured against a support surface of the second end. The weight assembly remains coupled to the sole in any intermediate position between the first and second positions.

In certain aspects, the invention provides a method for adjusting the mass properties of a golf club head. The method includes providing a golf club head having a club head body including a front portion, a rear portion, a ball-striking face, a heel, a toe, a crown, and a sole. The sole includes a track formed along a length thereof that defines a first end and an opposing second end adjacent to the front and rear portions of the club head body, respectively. The golf club head further includes a weight assembly coupled to the sole by way of a mechanical fastener extending through a portion of the weight assembly and into a channel of the track, and engaging a retaining member slidably positioned and retained within a portion of the channel of the track.

The method further includes adjusting the center of gravity and/or mass moment of inertia of the golf club head by moving the weight assembly between at least a first position and a second position along the sole. When in the first position, the weight assembly is received within and secured to the first end of the track and when in the second position, the weight assembly is received within and secured to the second end of the track.

In some embodiments, moving the weight assembly between the first and second positions includes loosening engagement of the mechanical fastener with the retaining member to a sufficient degree so as to allow removal of the weight assembly from either the first or second end of the track while still maintaining engagement between the mechanical fastener and retaining member. The method further includes moving the weight assembly along a length of the channel to the opposing end of the track and positioning the weight assembly within the opposing end of the track. The method further includes tightening engagement of the mechanical fastener with the retaining member to a sufficient degree so that the weight assembly is received within and secured to the opposing end of the track. In some embodiments, the method includes rotating the weight assembly about a longitudinal axis of the mechanical fastener prior to positioning the weight assembly within the opposing end of the track.

In certain aspects, the invention provides a golf club head having a club head body that includes a front portion, a rear portion, a ball-striking face at the front portion of the club head body, a heel, a toe, a crown, and a sole. The sole has a weight mounting portion formed on a portion thereof. The golf club head further includes a weight assembly releasably coupled to the weight mounting portion by way of a fastener. In some embodiments, the fastener is an externally threaded headed fastener extending through a portion of the weight assembly and engaging an internally threaded bore formed on the weight mounting portion.

In certain aspects, the invention provides a golf club head having a club head body that includes a front portion, a rear portion, a ball-striking face at the front portion of the club head body, a heel, a toe, a crown, and a sole. The sole has at least a first and a second weight mounting portion formed on a portion thereof. Each of the first and second weight mounting portions defines a recess having a support surface. The golf club head further includes a weight assembly positioned within the recess of one of the first or second weight mounting portions and releasably coupled thereto by way of an externally threaded headed fastener extending through a bore of the weight assembly and engaging an internally threaded bore formed on the support surface. The fastener is rotatably coupled to the weight assembly by way of a retaining element positioned between an inner surface of the bore of the weight assembly and a portion of the fastener extending through the bore.

In some embodiments, the weight assembly has a bore shaped and/or sized to receive a portion of the mechanical fastener therethrough and a channel formed along an inner surface thereof shaped and/or sized to receive a portion of the retaining element within. In some embodiments, the mechanical fastener has a head portion having a channel defined along an outer surface thereof and shaped and/or sized to receive a portion of the retaining element within. Upon insertion of the head of the mechanical fastener into the bore of the weight assembly, the retaining element is received within the channel of the bore and the channel of the head, thereby coupling the mechanical fastener to the weight assembly. The retaining element is adapted to allow the mechanical fastener to rotate while remaining coupled to the weight assembly.

In certain aspects, the invention provides a golf club head having a club head body that includes a front portion, a rear portion, a ball-striking face at the front portion of the club head body, a heel, a toe, a crown, and a sole. The sole has at least one weight mounting portion formed on a portion thereof. The golf club head further includes a weight assembly releasably coupled to the weight mounting portion by way of a fastener extending through a portion of the weight assembly and engaging a bore of the weight mounting portion. The weight assembly includes an outer cover, a weight member housed within a cavity of the outer cover, and a support member enclosing the weight member within the cavity of the outer cover and further coupling the main weight member to the outer cover. The fastener is rotatably coupled to the weight assembly by way of a retaining element positioned between a channel formed along an inner surface of a bore of the outer cover and a corresponding channel formed along an outer surface of a head portion of the fastener.

DETAILED DESCRIPTION

Figure 1:
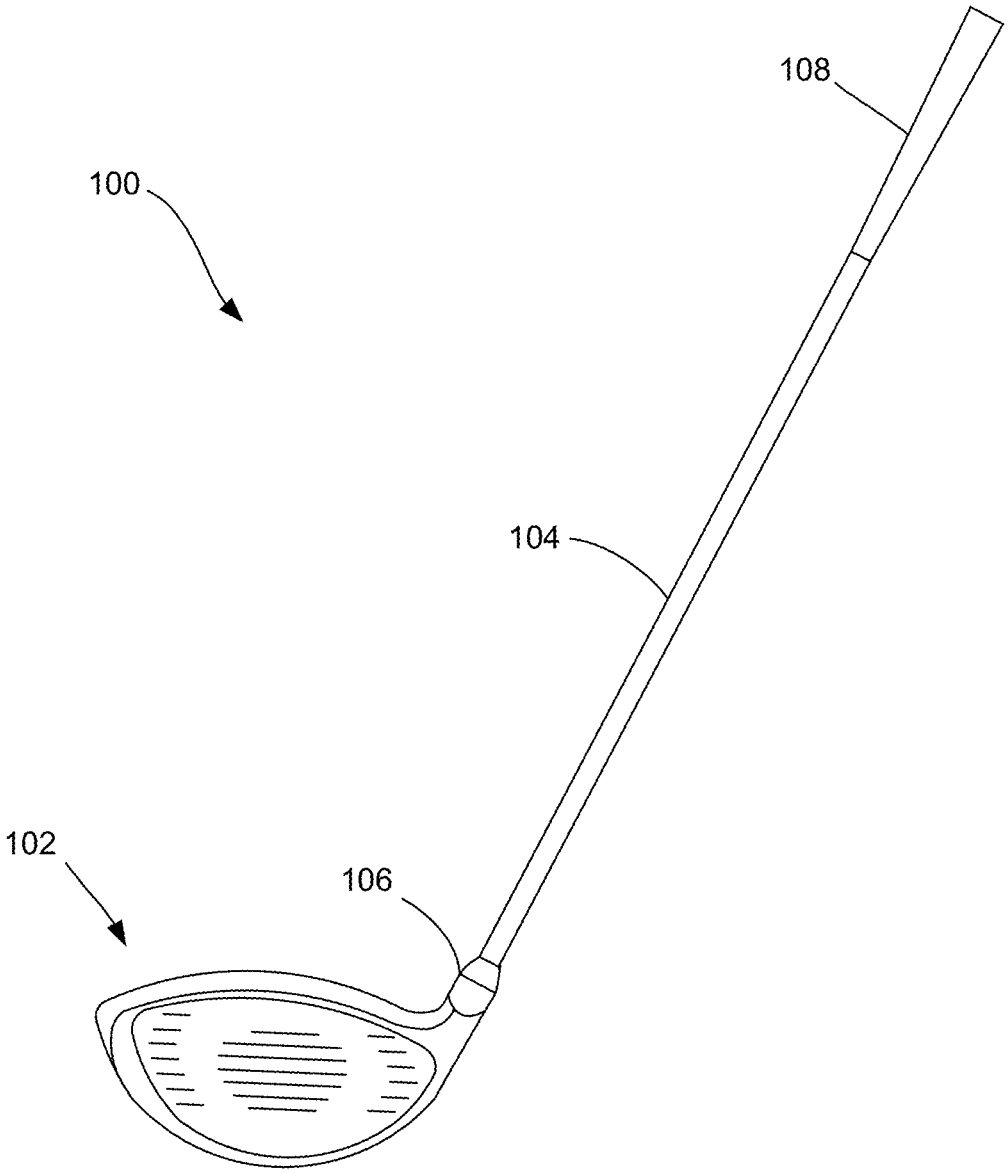
FIG. 1 shows an embodiment of a wood-type golf club including an embodiment of a club head consistent with the present disclosure.

By way of overview, the present invention is generally directed to methods and mechanisms for adjusting the mass properties of a golf club head so as to alter performance characteristics of the club head. More specifically, the present invention provides a solution to the problems of weighting in golf club heads that allows for greater flexibility in modifying the center of gravity, mass moment of inertia, and/or swingweight of a golf club.

The performance of a golf club can vary based on several factors, including weight distribution about the head, which generally affects the location of the center of gravity of the golf club head, as well as the mass moment of inertia. The center of gravity and mass moments of inertia critically affect a golf club head's performance, such as launch angle and flight trajectory on impact with a golf ball, among other characteristics.

For example, when the center of gravity is positioned behind the point of engagement on the contact surface, the golf ball follows a generally straight route. When the center of gravity is spaced to a side of the point of engagement, however, the golf ball may fly in an unintended direction and/or may follow a route that curves left or right, including ball flights that often are referred to as pulls, pushes, draws, fades, hooks, or slices. Similarly, when the center of gravity is spaced above or below the point of engagement, the flight of the golf ball may exhibit more boring or climbing trajectories, respectively.

A mass moment of inertia is a measure of a club head's resistance to twisting about the golf club head's center of gravity, for example, on impact with a golf ball. As generally understood, a moment of inertia of a mass about a given axis is proportional to the square of the distance of the mass away from the axis. In other words, increasing distance of a mass from a given axis results in an increased moment of inertia of the mass about that axis. Accordingly, a higher moment of inertia results in lower club head rotation on impact with a golf ball, particularly on "off-center" impacts with a golf ball (e.g., mis-hits). Lower rotation in response to a mis-hit results in a player's perception that the club head is forgiving. Generally, one measure of "forgiveness" can be defined as the ability of a golf club head to reduce the effects of mis-hits on flight trajectory and shot distance, e.g., hits resulting from striking the golf ball at a less than ideal impact location on the golf club head. Greater forgiveness of the golf club head generally equates to a higher probability of hitting a straight golf shot. Moreover, higher moments of inertia typically result in greater ball speed on impact with the golf club head, which can translate to increased golf shot distance.

Embodiments of the invention provide a golf club head having a club head body that includes a front portion, a rear portion, a ball-striking face at the front portion, a heel, a toe, a crown, and a sole. The sole has a track formed along a length thereof and defines a first end and an opposing second end adjacent to the front and rear portions of the club head body, respectively. The golf club head further includes an adjustable weight assembly adapted to move to different positions along a length of the sole of the club head body, while remaining coupled to the club head at all times during positioning of the weight. The mass distribution of the golf club head can be changed based on different positions of the weight assembly, resulting in different performance characteristics (e.g., greater distance, improved accuracy, etc.). Accordingly, the present invention provides a golfer with a mechanism to easily and quickly adjust mass distribution properties of the club head to the golfer's specifications.

Referring to the figures and following description, golf clubs and golf club heads in accordance with the present invention are described. The golf club and club head structures described herein may be described in terms of wood-type golf clubs. However, the present invention is not limited to the precise embodiments disclosed herein but applies to golf clubs generally, including hybrid clubs, iron-type golf clubs, utility-type golf clubs, and the like.

Example golf club and golf club head structures in accordance with this invention may relate to "wood-type" golf clubs and golf club heads, e.g., clubs and club heads typically used for drivers and fairway woods, as well as for "wood-type" utility or hybrid clubs, or the like. Although these club head structures may have little or no actual "wood" material, they still may be referred to conventionally in the art as "woods" (e.g., "metal woods," "fairway woods," etc.).

Turning now to FIG. 1, an embodiment of a wood-type golf club 100 that may be used in accordance with embodiments of a golf club head of the present disclosure is generally illustrated. As shown, the wood-type golf club 100 may include a wood-type golf club head 102 in accordance with the present disclosure. In addition to the golf club head 102, the overall golf club structure 100 may include a shaft 104 and a grip or handle 108 attached to one end of the shaft 102. The shaft 104 may be received in, engaged with, and/or attached to the golf club head 102 in any suitable or desired manner, including in conventional manners known and used in the art, without departing from the disclosure. As described in greater detail herein, the shaft 104 may be engaged with the golf club head 102 through a shaft-receiving sleeve or element extending into the club head 102 (e.g., a hosel 106), and/or directly to the club head structure 102. The shaft 104 may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like.

The grip or handle 108 may be attached to, engaged with, and/or extend from the shaft 104 in any suitable or desired manner, including in conventional manners known and used in the art, e.g., using adhesives or cements, etc. As another example, if desired, the grip or handle 108 may be integrally formed as a unitary, one-piece construction with the shaft 104. Additionally, any desired grip or handle materials may be used without departing from this disclosure, including, but not limited to, rubber materials, leather materials, other materials including cord or other fabric material embedded therein, polymeric materials, and the like.

Further, according to aspects of the disclosure, the golf club 100 may include a hosel 106. The shaft 104 may be received in and/or inserted into and/or through the hosel 106. The hosel 106 may be configured such that the shaft 104 may be engaged with the hosel 106 in a releasable manner using mechanical connectors to allow easy interchange of one shaft for another on the head. For example, threads, locking mechanisms, etc. may be incorporated into the hosel 106 and the end of the shaft 104 that is to be engaged with the hosel 106 may be configured with a corresponding configuration. In some embodiments, the shaft 104 may be secured to the hosel 106 via bonding with adhesives or cements, welding (e.g., laser welding), soldering, brazing, or other fusing techniques, etc. In some embodiments, the hosel 106 may be eliminated and the shaft 104 may be directly attached to the golf club head 102. For example, the shaft 104 may be directly engaged with the golf club head 102 (e.g., by bonding with adhesives or cements, welding (e.g., laser welding), soldering, brazing, or other fusing techniques, etc.).

Figure 2:
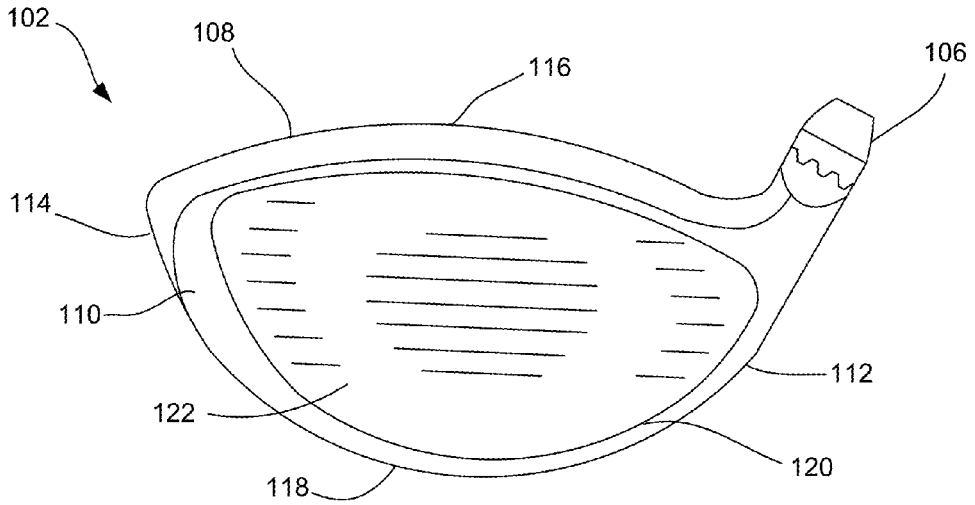
FIG. 2 is a front view of a golf club head according to some embodiments.
Figure 3:
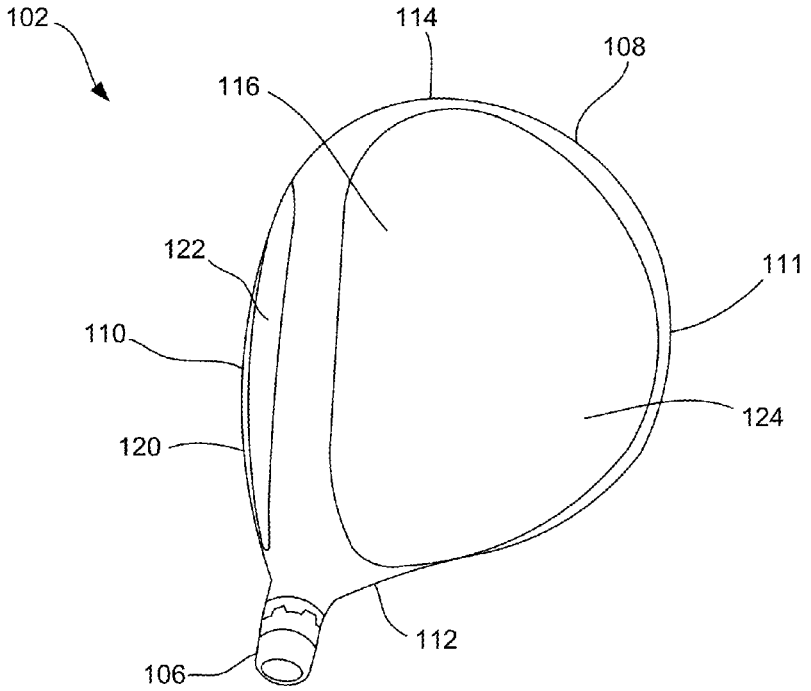
FIG. 3 is a top view of a golf club head according to some embodiments.

FIGS. 2 and 3 are front and top views of a golf club head according to some embodiments of the present invention. As shown, the golf club head 102 has a club head body 108 having a hosel 106, a front portion 110, a rear portion 111, a heel 112, a toe 114, a crown 116, a sole 118, and a ball-striking face 120.

As generally understood, a wide variety of overall club head constructions are possible without departing from this invention. For example, if desired, some or all of the various individual parts of the club head 102 described above may be made from multiple pieces that are connected together (e.g., by welding, adhesives, or other fusing techniques; by mechanical connectors; etc.). The various parts (e.g., heel, toe, crown, sole, ball-striking face, portions of the body, etc.) may be made from any desired materials and combinations of different materials, including materials that are conventionally known and used in the art, such as metal materials, including lightweight metal materials. More specific examples of suitable lightweight metal materials include steel, titanium and titanium alloys, aluminum and aluminum alloys, magnesium and magnesium alloys, etc.

As additional examples or alternatives, in order to reduce the club head 102 weight, one or more portions of the club head structure 102 advantageously may be made from a composite material, such as from carbon fiber composite materials that are conventionally known and used in the art. Other suitable composite or other non-metal materials that may be used for one or more portions of the club head structure 102 include, for example: fiberglass composite materials, basalt fiber composite materials, polymer materials, etc. As described in greater detail herein, at least some portion(s) of the body 108 may be made from composite or other non-metal materials. As yet further examples, the entire body 108 of the club head 102 may be made from composite or other non-metal materials without departing from this invention. The composite or other non-metal material(s) may be incorporated as part of the club head structure 102 in any desired manner, including in conventional manners that are known and used in the art.

Reducing the club head's weight (e.g., through the use of composite or other non-metal materials, lightweight metals, metallic foam or other cellular structured materials, etc.) allows club designers and/or club fitters to selectively position additional weight in the overall club head structure 102, e.g., to desirable locations to increase the moment of inertia, affect the center of gravity location, and/or affect other playability characteristics of the club head structure 102 (e.g., to draw or fade bias a club head; to help get shots airborne by providing a low center of gravity; to help produce a lower, more boring ball flight; to help correct or compensate for swing flaws that produce undesired ball flights, such as hooks or slices, ballooning shots, etc.).

The various individual parts that make up a club head structure 102, if made from multiple pieces, may be engaged with one another and/or held together in any suitable or desired manner, including in conventional manners known and used in the art. For example, a separate ball-striking plate insert 122 may be joined to the ball-striking face 120 and a separate crown panel insert 124 may be joined to the club head body 108 (directly or indirectly through intermediate members) by adhesives, cements, welding, soldering, or other bonding or finishing techniques, and the like. The ball striking plate insert 122 may be comprised of one or more materials. The material(s) of the ball striking plate insert should be relatively durable to withstand the repeated impacts with the golf ball. For example, the ball striking plate insert 122 may comprise a high strength steel. Further, other materials, such as titanium or other metals or alloys may be used as well.

In some arrangements, the various parts of the club head 102 may be joined by mechanical connectors (such as threads, screws, nuts, bolts, or other connectors), and the like. In some embodiments, the mating edges of various parts of the club head structure 102 (e.g., the edges where heel, toe, crown, sole, ball-striking face, and/or other parts of the body contact and join to one another) may include one or more raised ribs, tabs, ledges, or other engagement elements that fit into or onto corresponding grooves, slots, surfaces, ledges, openings, or other structures provided in or on the facing side edge to which it is joined. Cements, adhesives, mechanical connectors, finishing material, or the like may be used in combination with the raised rib/groove/ledge/edge or other connecting structures described above to further help secure the various parts of the club head structure 102 together.

Figure 4:
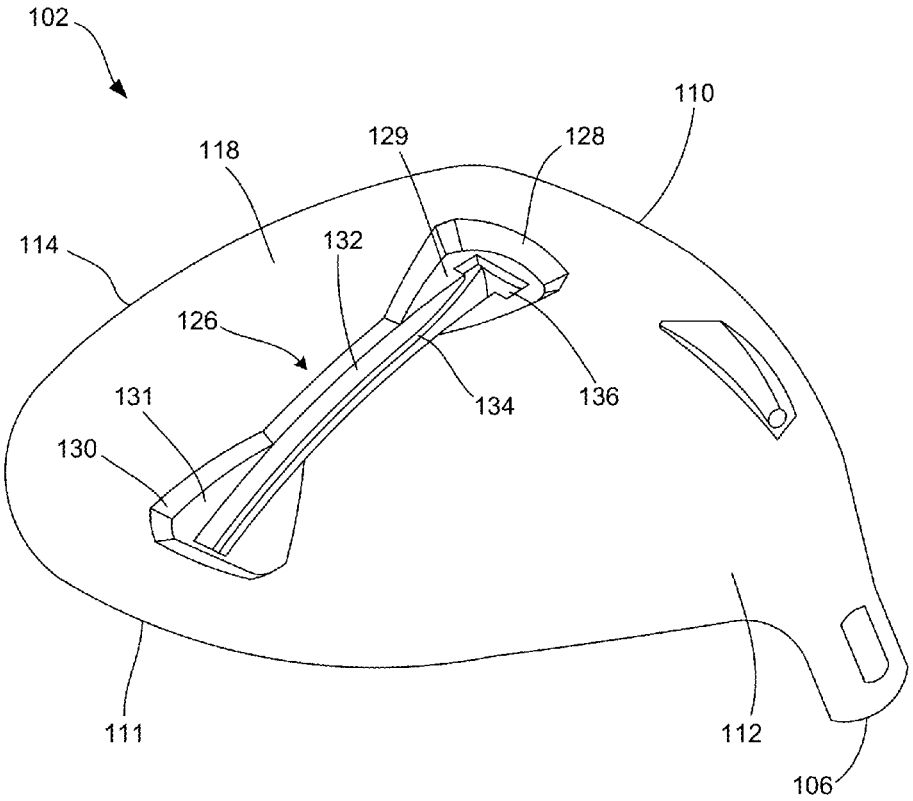
FIG. 4 is a perspective view of a golf club head illustrating a sole according to some embodiments.
Figure 5:
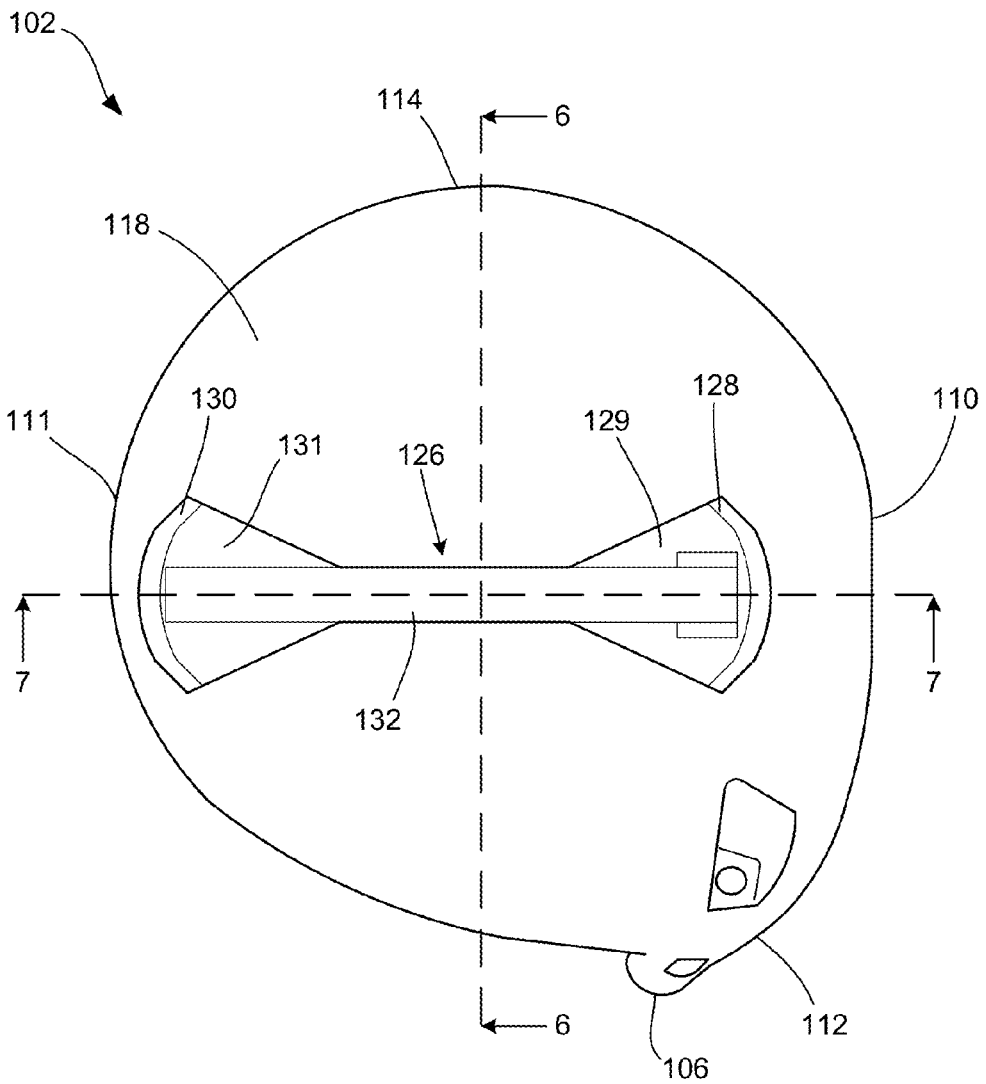
FIG. 5 is a bottom view of a golf club head illustrating a sole according to some embodiments.
Figure 6:
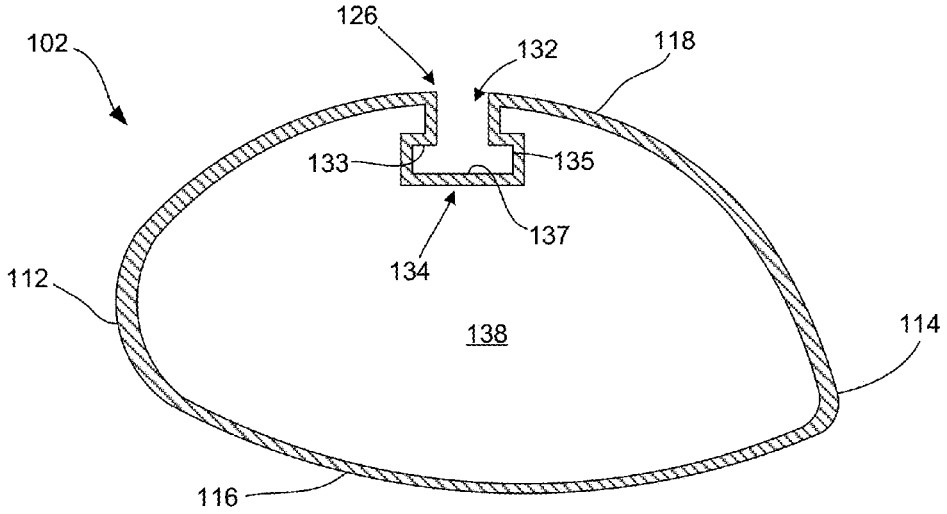
FIG. 6 is a sectional view of the club head of FIG. 5 taken along lines 6-6.
Figure 7:
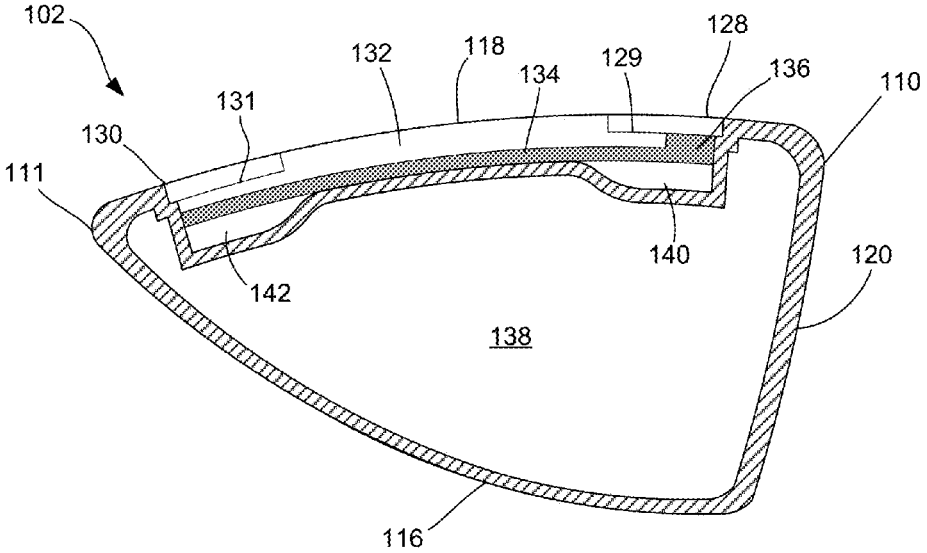
FIG. 7 is a sectional view of the club head of FIG. 5 taken along lines 7-7.

FIGS. 4 and 5 are perspective and bottom views of a golf club head 102 illustrating a sole 118 according to some embodiments. FIG. 6 is a sectional view of the club head 102 of FIG. 5 taken along lines 6-6 and FIG. 7 is a sectional view of the club head 102 of FIG. 5 taken along lines 7-7. As shown, the sole 118 has a track 126 formed along a length thereof extending from the front portion 110 to the rear portion 111 of the club head body 108. The track 126 includes a first end 128 adjacent to the front portion 110 and an opposing second end 130 adjacent to the rear portion 111. As described in greater detail herein, the first and second ends 128, 130 of the track 126 are shaped and/or sized to receive an adjustable weight assembly within (shown in FIGS. 8-14). As shown, the first end 128 and the second end 130 each have a support surface 129, 131, respectively, for supporting the weight assembly when the weight assembly is positioned therein.

As shown, the track 126 is generally linear and extends from the front portion 110 to the rear portion 111 of the club head 102. It should be understood, however, that a club head 102 consistent with the present disclosure may include any number of tracks 126 having any number of configurations, geometries, shapes, etc. For example, as described in greater detail herein (shown in FIGS. 25 and 26), a club head according to some embodiments may include multiple tracks formed along different portions of the sole, resulting in a variety of different positions in which to mount a weight assembly, thereby providing multiple performance characteristics from which a golfer may choose.

Referring to FIGS. 6 and 7, the track 126 further includes a channel 132 extending from an exterior surface of the sole 118 towards an internal cavity 138 of the club head body 108. The channel 132 lies along a plane that extends generally from the sole 118 to the crown 116 of the club head body 108. The channel 132 includes upper inner walls 133, inner sidewalls 135 extending from the upper inner walls 133 and towards a bottom inner wall 137. The inner walls 133, 135, 137 generally form a groove 134 that extends along length of the channel 132. The groove 134 lies along a plane that extends generally from the heel 112 to the toe 114 of the club head body 108, such that the plane along which the groove 134 lies is substantially orthogonal to the plane upon which the channel 132 lies.

The groove 134 is a shape and/or sized to receive a retaining member (e.g., washer, nut, etc.) therein by way of an entrance portion 136 formed proximate the first end 128 of the track. The entrance portion 136 is generally a portion of groove 134 in which side walls 135 of the channel 132 have been widened to allow a retaining member to pass into the groove 134. As described in greater detail herein, the weight assembly is coupled to the sole 118 by way of a fastening mechanism, including a mechanical fastener (e.g., bolt) extending through a portion of the weight assembly, into the channel 132, and engaging the retaining member positioned within the groove 134. Accordingly, the retaining member is adapted to retain the weight assembly along a portion of the sole 118 by way of engagement with the mechanical fastener. The retaining member is further adapted to slide along the groove so as to allow the weight assembly to move along a length of the track 126 when positioning the weight assembly, thereby allowing the weight assembly to remain coupled to the sole 118 during arrangement of the weight assembly, as described in greater detail herein.

As shown, the depth of the channel 132 may vary along a length of the track 126. For example, the channel 132 may be deeper at each of the first and second ends 128, 130 of the track 126 and may taper to a more shallow depth at or near a center point of the track 126 (at a position between the first and second ends 110, 111). For example, the channel 132 may include first and second ends 140, 142 adjacent the first and second ends 128, 130 of the track 126. The first and second ends 140, 142 may generally form pockets or bosses of empty space providing sufficient clearance for receipt of a portion of the mechanical fastener when the weight assembly is positioned within and secured to either of the first or second ends 128, 130, described in greater detail herein.

A golf club head 102 consistent with the present disclosure, including one or more parts (e.g., heel, toe, crown, sole, etc.), as well as separate components (e.g., fastener, retaining member, etc.) may be fabricated using an additive process, such as, powdered metal sintering and metal deposition. For example, the sole 118, including the track 126, the channel 132 and groove 134 formed therein, as well as the retaining member, can be fabricated via additive manufacturing processes, such that the retaining member is simultaneously formed within the groove as a result of the manufacturing processes, as described for example in Soracco et al. (U.S. Pat. No. 8,007,373), Soracco et al. (U.S. Patent Application Publication No. 2011/0277313), and Soracco et al. (U.S. Patent Application Publication No. 2013/0097050), the contents of each of which is incorporated by reference herein in its entirety.

One example way to improve performance of the club, or accuracy, distance, etc. of a shot, is by adjusting mass distribution properties of the club head to one or more regions in order to adjust a center of gravity, mass moment of inertia, and/or swingweight of the club head. FIGS. 8-14 illustrate one example arrangement of a golf club head having an adjustable weight assembly that may be adjusted by an end user to alter the performance characteristics of the golf club by adjusting the mass distribution properties of the club head.

Figure 8:
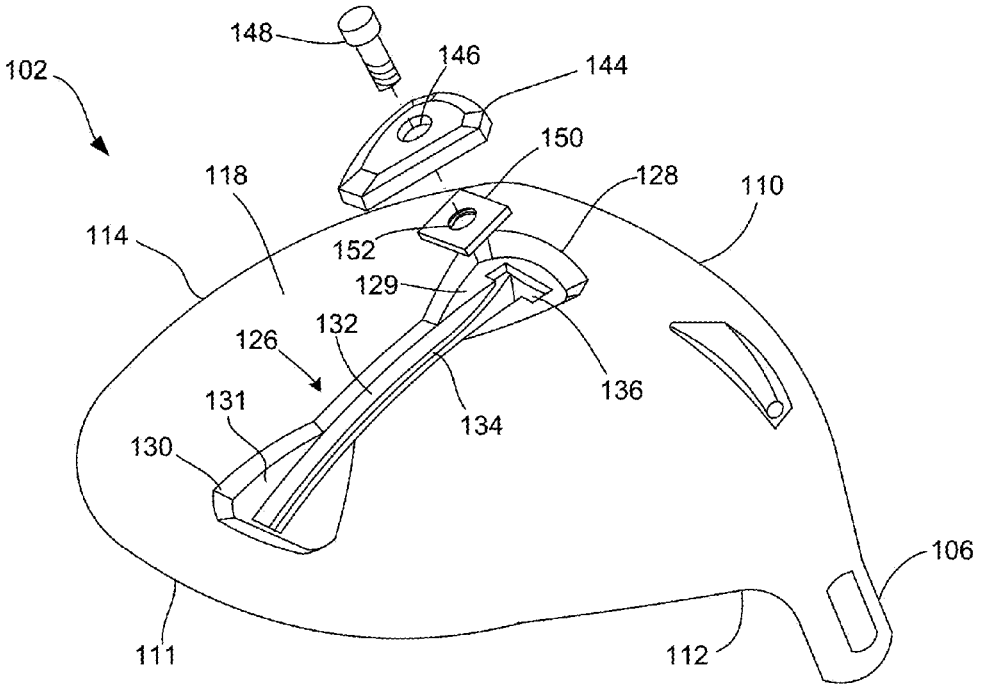
FIG. 8 is a perspective view of a golf club head illustrating a sole and an adjustable weight assembly according to some embodiments.

FIG. 8 is a perspective view of a golf club head 102 illustrating the sole 118 and an adjustable weight assembly 144 for use with the track 126 formed on the sole 118. The weight assembly 144 is coupled to the sole 118, specifically the track 126, by way of an elongate mechanical fastener 148 extending through a portion of the weight assembly 144, into the channel 132, and engaging a portion of a retaining member 150. In the illustrated embodiment, the weight assembly 144 includes a bore 146 shaped and/or sized to receive the fastener 148 therethrough. Similarly, the retaining member 150 includes a bore 152 shaped and/or sized to receive a portion of the fastener 148. In one embodiment, the fastener 148 includes external threading configured to engage an internally threaded bore 152 of the retaining member 150. In one embodiment, the fastener 148 is a bolt and the retaining member 150 is a nut or washer. It should be noted that the fastener 148 is not limited to a bolt, and may include any other type of suitable fastener, such as a barbed post, a cotter pin, or other binder.

As previously described, the retaining member 150 is positioned within and retained by the groove 134 formed within the channel 132 of the track 126. The groove 134 is generally shaped and/or sized to allow the retaining member 150 to translate (e.g., slide) along a length of the groove 134 from the first end 128 of the track 126 to the second end 130 of the track 126. Accordingly, upon extending the fastener 148 through a portion of the weight assembly 144, into the channel 132, and in engagement with the retaining member 150 (which is positioned within the groove 134), the weight assembly 144 is adapted to move along a length of the track 126 between a first position and a second position, and any intermediate positions in between, while remaining coupled to the sole 118 at any position.

Figure 9:
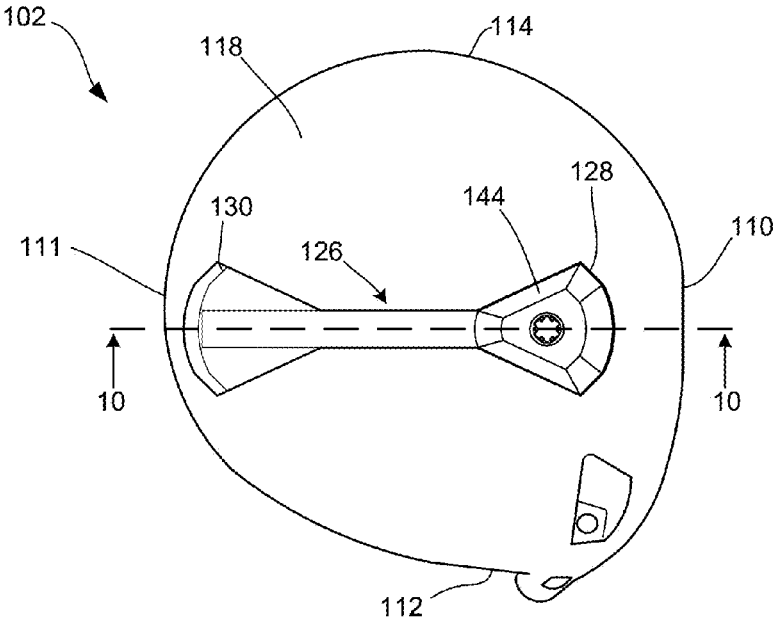
FIG. 9 is a bottom view of a golf club head illustrating a weight assembly in a first position along the sole according to some embodiments.
Figure 10:
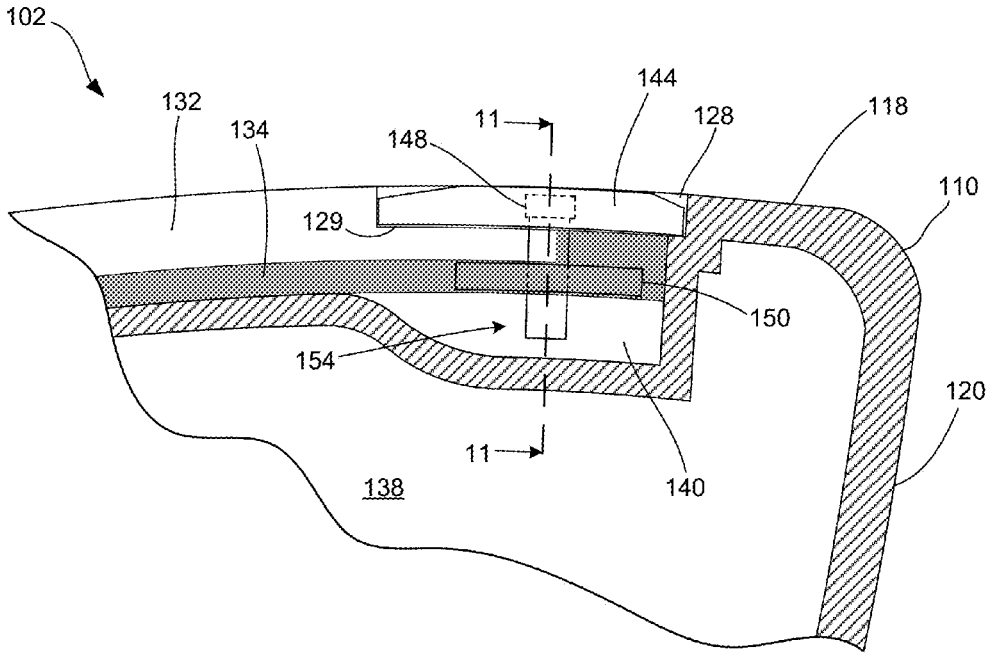
FIG. 10 is an enlarged sectional view of a portion the club head of FIG. 5 taken along lines 10-10.
Figure 11:
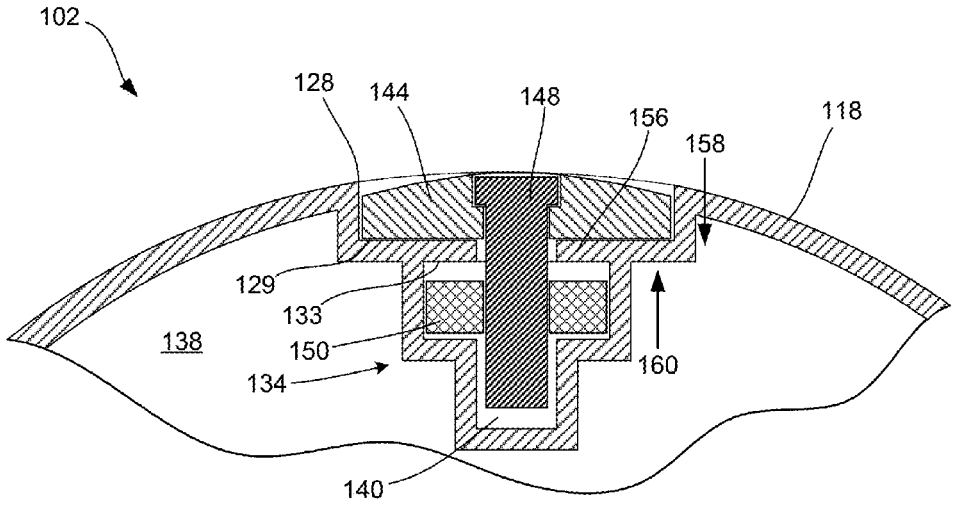
FIG. 11 is an enlarged sectional view of a portion of the club head of FIG. 10 taken along lines 11-11.

FIG. 9 is a bottom view of the golf club head 102 illustrating the weight assembly 144 in a first position along the sole 118 according to some embodiments. FIG. 10 is an enlarged sectional view of a portion the club head of FIG. 5 taken along lines 10-10 and FIG. 11 is an enlarged sectional view of a portion of the club head of FIG. 10 taken along lines 11-11.

As shown, when in the first position, the weight assembly 144 is received within and secured to the first end 128 of the track 126. More specifically, the mechanical fastener 148 is adapted to secure the weight assembly 144 against the support surface 129 of the first end 128 by way of the engagement with the retaining member 150 and further draw the retaining member 150 against the upper inner wall 133 of the channel 132. For example, as shown in FIG. 11, as the fastener 148 engages a threaded portion of the retaining member 150, a portion of the fastener (e.g., head) engages a portion of the weight assembly 144 and draws the weight assembly 144 in a direction towards the support surface 129 of the first end 128, as indicated by arrow 158. Similarly, the tightening action further draws the retaining member 150 in a direction towards the upper inner wall 133 of the channel 132, as indicated by arrow 160. The weight assembly 144 and the retaining member 150 are both drawn towards one another until both engage either side of a casting wall 156 which is formed by the support surface 129 and the upper inner wall 133. Accordingly, the weight assembly 144 and retaining member 150 effectively clamp the casting wall 156, thereby securing the weight assembly 144 against the support surface 129 of the first end 128 and the retaining member 150 against the upper inner wall 133 of the channel 132.

As previously described, The groove 134 may be shaped and/or sized to prevent rotation of the retaining member 150 therein, thereby allowing the fastener 148 to increase/decrease engagement (e.g., tighten or loosen) with the retaining member 150. The first end 140 of the channel 132 provides sufficient clearance for an end of the fastener 148, as indicated by arrow 154. In the illustrated embodiment, the first end 128 has a shape corresponding to a shape and/or contour of the weight assembly 144.

In some embodiments, the first end 128 may be shaped and/or sized to receive the entire weight assembly 144 within. In some embodiments, the weight assembly 144 may be below an exterior surface of the sole 118 when in the first position, such that the weight assembly 144 does not protrude from the sole 118 of the club head body 108. This may be particularly advantageous with regard to aerodynamics of the club head, as it may reduce drag during the swing, as well as improve turf interaction (reduces the opportunity for the weight assembly to dig into the turf just prior to or during impact with the ball).

Figure 12:
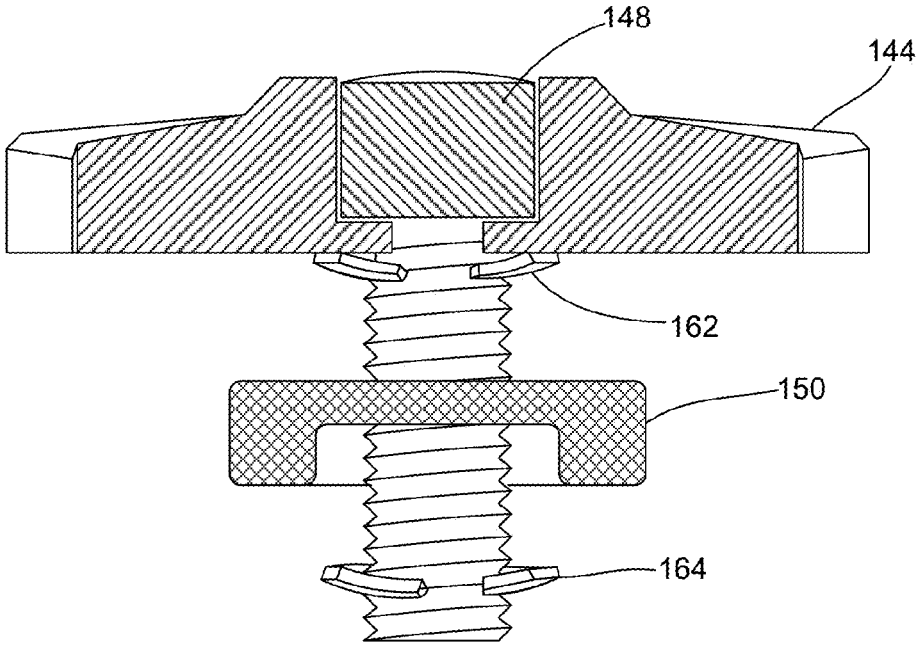
FIG. 12 is a side view, partly in section, of an adjustable weight assembly and a fastening mechanism for securing and loosening the weight assembly to and from a golf club head according to some embodiments.

FIG. 12 is a side view, partly in section, of an adjustable weight assembly 144 including one or more retaining clips 162, 164 for retaining one or more components to one another. As shown, a retaining clip 162 may be positioned on a portion the fastener 148 (e.g., adjacent the head portion) so as to retain the fastener 148 within the bore of the weight assembly 144 (e.g., prevents slippage of the fastener out of the weight assembly 144). The retaining clip 162 is adapted to allow rotation of the fastener 148 while keeping the fastener 148 coupled to the weight assembly 144, so as to reduce the chances of losing both components if completely removing the weight assembly from the track 126. Additionally, or alternatively, another retaining clip 164 may be positioned on a portion of the fastener 148 (e.g., adjacent the distal end of the fastener 148) so as to retain the fastener within the bore of the retaining member 150 (e.g., prevents retaining member 150 from completely separating from the fastener 148). Similar to retaining clip 162, the additional retaining clip 164 still allows rotation of the fastener 148 (to allow coupling and decoupling of weight assembly in first and second positions) while preventing the retaining member 150 from completely separating from the fastener 148, thereby ensuring that the weight assembly 144 is coupled to the track 144 at all times when moving between different positions.

Figure 13:
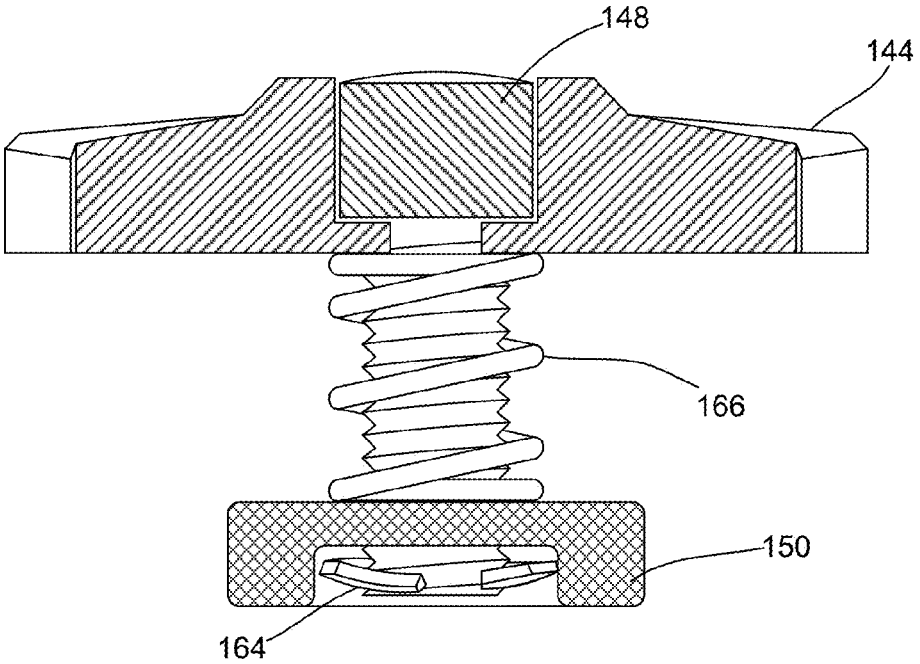
FIG. 13 is a side view, partly in section, of an adjustable weight assembly and a fastening mechanism for securing and loosening the weight assembly to and from a golf club head according to some embodiments.

FIG. 13 is a side view, partly in section, of an adjustable weight assembly 144 including a spring 166 coupled to the fastener 148 and positioned between the weight assembly 144 and the retaining member 150. It should be noted that any element for storing mechanical energy may be used in this embodiment, and is not be limited to a spring. As generally understood, the spring 166 is adapted to store mechanical force upon compression. Accordingly, upon tightening the fastener 148 to the retaining member 150, the weight assembly 144 and retaining member 150 are drawn towards one another, such that the spring 166 is compressed and stores mechanical energy, applying a biasing force against at least the weight assembly 144. In the event that a golfer wishes to move the weight assembly from one position to another, the golfer will loosen engagement between the fastener 148 and retaining member 150. Upon loosening the fastener 148, the spring 166 applies biasing force against the weight assembly 144 in a direction away from the retaining element 150, thereby resulting in the weight assembly 144 being forced in a direction away from the retaining member 150. Accordingly, when the golfer loosens the fastener 148 to move the weight assembly from a first position to a second position, for example, the spring 166 is adapted to effectively force the weight assembly out of engagement with the first end 128 of the track 126. Thus, the incorporation of the spring element 166 may essentially ease the repositioning process of the weight assembly.

Figure 14:
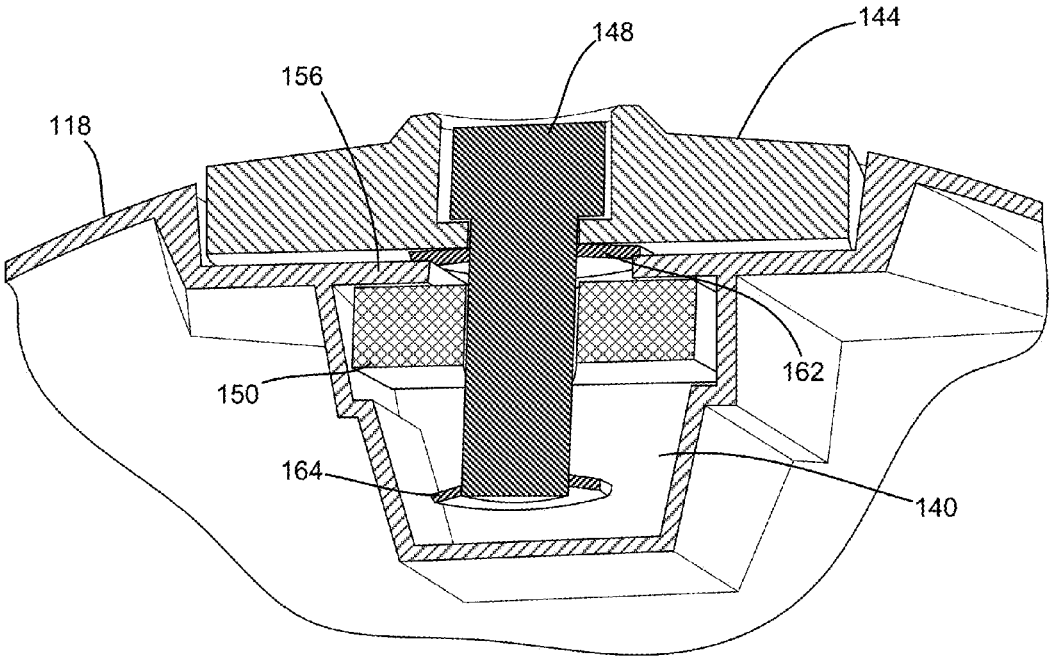
FIG. 14 is an enlarged sectional view of the club head of FIG. 5 taken along lines 7-7 illustrating the weight assembly in a first position and coupled to the sole of the golf club head by way of the fastening mechanism of FIG. 12.
Figure 15:
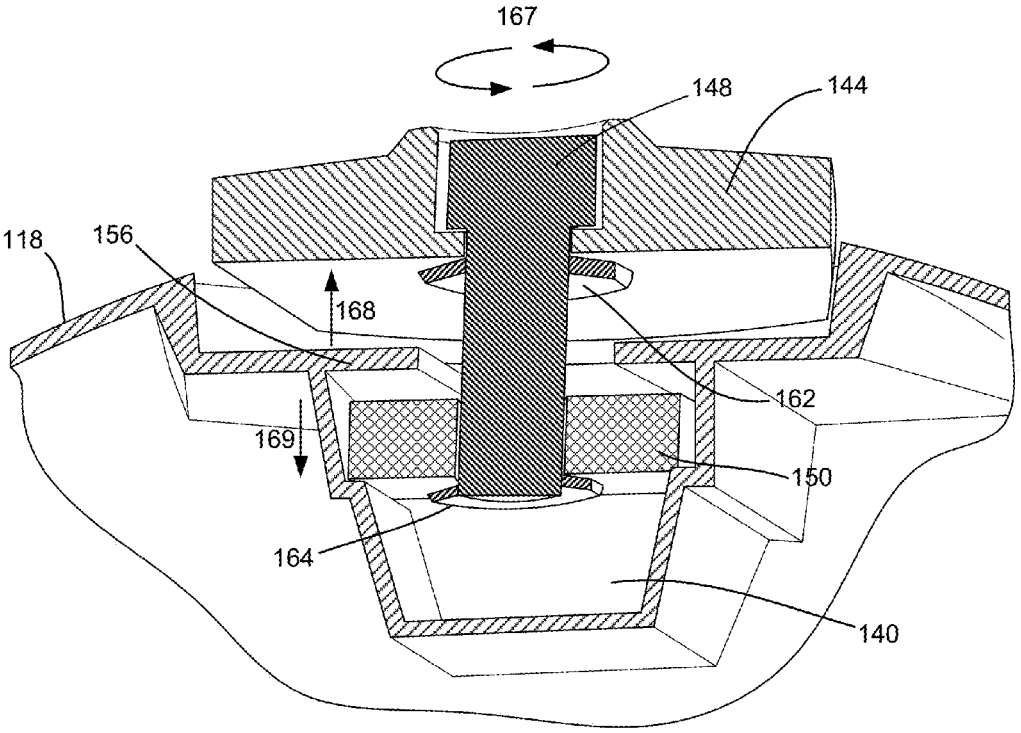
FIG. 15 is an enlarged sectional view of the club head of FIG. 5 taken along lines 7-7 illustrating the weight assembly in a loosened configuration and removed from the first position by way of the fastening mechanism of FIG. 12.

FIG. 14 is an enlarged sectional view of the club head of FIG. 5 taken along lines 7-7 illustrating the weight assembly 144 in a first position and coupled to the sole 118 of the golf club head 102 by way of the fastening mechanism depicted in FIG. 12. FIG. 15 is an enlarged sectional view of the club head of FIG. 5 taken along lines 7-7 illustrating the weight assembly 144 in a loosened configuration and removed from the first position by way of the fastening mechanism of FIG. 12. As previously described, one or more retaining clips 162, 164 may be positioned on the fastener 148 and are adapted to maintain engagement of the fastener with at least one of the weight assembly 144 and retaining member 150. For example, in the event the golfer wishes to reposition the weight assembly 144, the golfer need only loosen the fastener 148, indicated by arrow 167. Upon loosening the fastener 148, the weight assembly 144 and retaining member 150 are drawn in opposite directions away from one another and disengage from the casting wall 156. For example, the weight assembly 144 moves out of the first end 128 and away from the sole casting wall 156, as indicated by arrow 168, and the retaining member 150 moves away from the casting wall 156 and towards an internal cavity 138 of the club head 102, as indicated by arrow 169.

Retaining clips 162 and 164 allow the fastener 148 to rotate, while keeping the fastener 148 coupled to the weight assembly 144 and retaining member 150, respectively. For example, as shown, retaining clip 162 is positioned adjacent to the head portion of the fastener 148, between the weight assembly 144 and retaining member 150, so as to maintain the positioning of the fastener 148 within the bore of the weight assembly 144. Retaining clip 164 is positioned at a distal end of the fastener 148, just below retaining member 150, such that the retaining clip 164 prevents the retaining member 150 from completely disengaging from the fastener 148 by essentially limiting the length that the retaining member 150 can travel along the fastener 148. Accordingly, a golfer may continue to rotate the fastener 148 indefinitely while the retaining clip 164 keeps the fastener 148 coupled to the retaining member 150, thereby ensuring that the weight assembly 144 is coupled to the track 144 at all times when moving between different positions.

Figure 16:
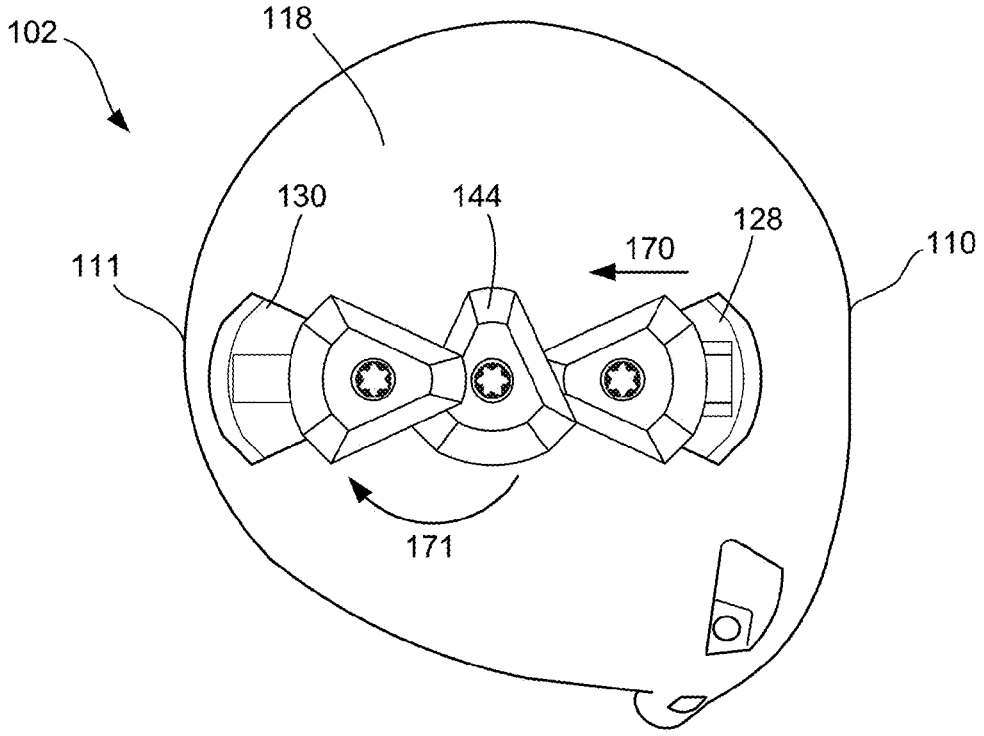
FIG. 16 is a bottom view of a golf club head illustrating movement of a weight assembly from the first position to a second position along the sole according to some embodiments.
Figure 17:
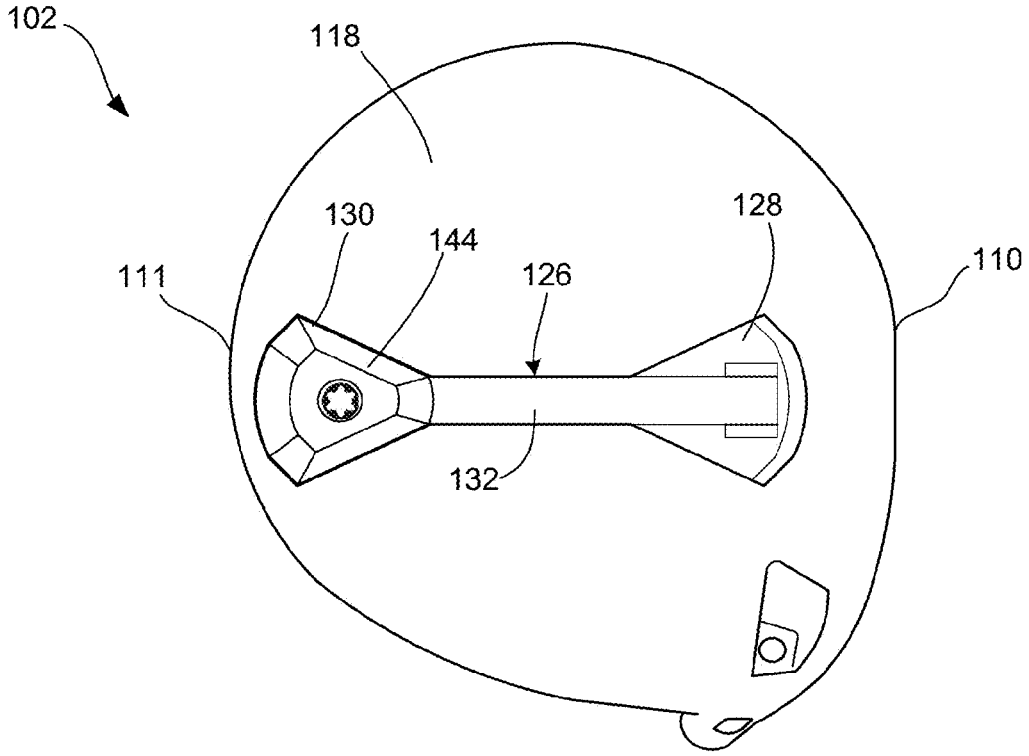
FIG. 17 is a bottom view of a golf club head illustrating a weight assembly in the second position along the sole according to some embodiments.
Figure 18:
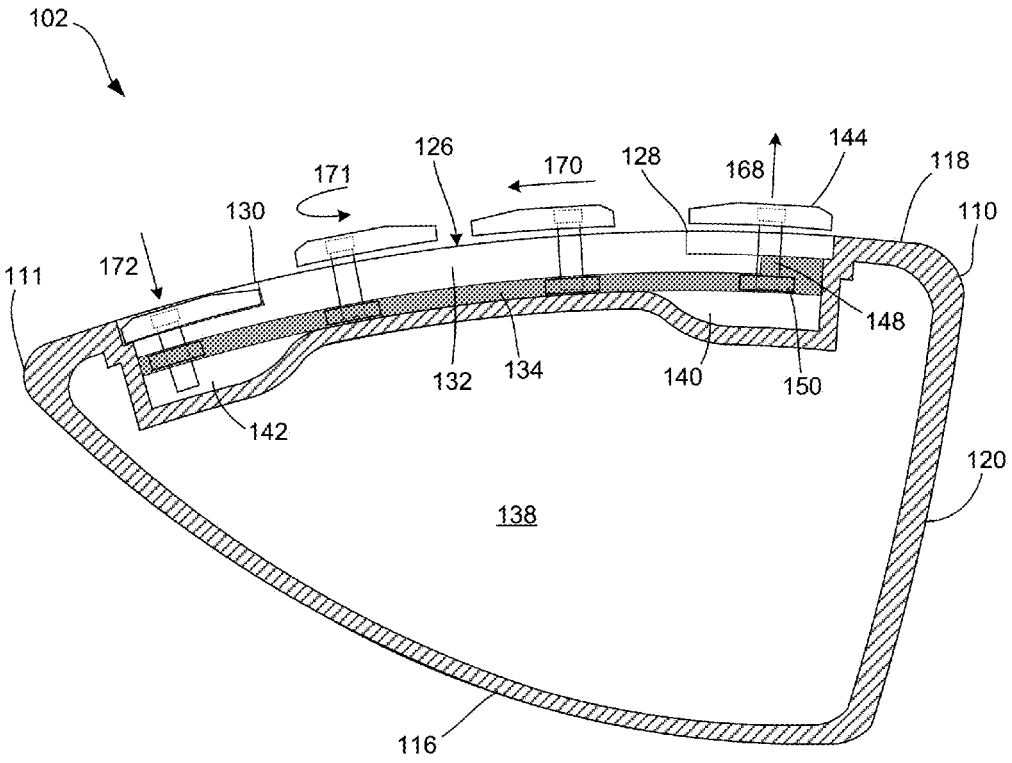
FIG. 18 is a sectional view the club head of FIG. 5 taken along lines 7-7 illustrating movement of a weight assembly from a first position to a second position along a length of the sole according to some embodiments.

FIG. 16 is a bottom view of a golf club head 102 illustrating movement of the weight assembly 144 from the first position to a second position and FIG. 17 is a bottom view of a golf club head 102 illustrating the weight assembly 144 in the second position. FIG. 18 is a sectional view the club head 102 illustrating movement of the weight assembly 144 from a first position to a second position. In the event that a golfer wishes to adjust the weight assembly 144 from the first position to the second position, the golfer need only use a tool, such as a specialty tool with a custom tip, to unfasten the fastener 148 via a tool interface surface, such as a shaped recessed tool port, so as to release the weight assembly 144 from the first end 128 of the track 126.

Upon loosening the engagement between the fastener 148 and the retaining member 150 (without completely disengaging the fastener 148 from the retaining member 150), a golfer may then remove the weight assembly 144 from the first end 128, as indicated by arrow 168 in FIG. 18. The golfer may then move the weight assembly 144 along the track 126 in a direction towards the second end 130, as indicated by arrow 170. In particular, as previously described, the retaining member 150 is adapted to slide along the groove 134 while remaining retained within the groove 134 and in engagement with the fastener 148. Accordingly, the weight member 144 is able to move along the track 126 from the first end 128 to the second end 130 while remaining coupled to the sole 118, thus preventing the opportunity for the golfer to misplace or lose the weight assembly 144 (which could otherwise occur if the weight assembly was required to be removed completely).

In some embodiments, the weight assembly 144 may be rotated prior to being received within and secured to the second end 130 of the track. For example, in some embodiments, the weight assembly 144 may have a particular shape or contour that requires rotation in order to fit within the opposing second end 130 of the track 126. This can provide the golfer with further indication that the weight assembly 144 is properly placed within the correct end 128, 130. In other embodiments, the weight assembly 144 may have a particular weight distribution depending on its orientation (e.g., increased mass in a specific portion of the assembly). As such, a golfer may rotate the weight assembly 144 to further customize the alteration of the mass distribution properties of the golf club head 102.

In the illustrated embodiment, the weight assembly 144 may be rotated 180° about a longitudinal axis of the fastener 148, as indicated by arrow 171, prior to positioning the weight assembly within the second end 130. It should be noted that in some embodiments, depending on the configuration of the track(s) and different positions along the track(s), the weight assembly 144 may require various degrees of rotation (e.g., in the range of 0° to 180°). Upon reaching the second end 130, the golfer may then position the weight assembly within the second end 130 and tighten the fastener 148 to the retaining member 150, such that a portion of the fastener (e.g., head) engages a portion of the weight assembly 144 and draws the weight assembly 144 in a direction towards the internal cavity 138 of the club head 102, thereby securing the weight assembly 144 against the support surface 131 of the second end 130, as indicated by arrow 172. Similar to the first end 140, the second end 142 of the channel 132 provides sufficient clearance for an end of the fastener 148. Similar to the first end 128, the second end 130 has a shape corresponding to a shape and/or contour of the weight assembly 144. In some embodiments, the second end 128 may be shaped and/or sized to receive the entire weight assembly 144 within. In some embodiments, the weight assembly 144 may be below an exterior surface of the sole 118 when in the second position, such that the weight assembly 144 does not protrude from the sole 118 of the club head body 108.

The mass distribution of the golf club head 102 can be changed based on different positions of the weight assembly 144. For example, when the weight assembly is in the first position (received within and secured to the first end 128 of the golf club head 102) the golf club head has a center of gravity that is lower than when the weight assembly 144 is in the second position. When the weight assembly 144 is in the second position (received within and secured to the second end 130), the golf club head 102 has a moment of inertia that is greater than when the weight assembly 144 is in the first position. The different characteristics and performance statistics associated the different positions of the weight assembly are provided in Table 1 below:

TABLE 1

Characteristics and Performance Statistics of Weight Assembly

| Weight Placement (on Sole) | CG Neutral | MOI | CG Depth | MPH | Degrees | RPM |
|---|---|---|---|---|---|---|
| Front | 1.0 mm | 4000 | 33.0 mm | 160 | 12.5 | 2650 |
| Back | 3.0 mm | 4800 | 38.0 mm | 160 | 12 | 3000 |

Accordingly, the present invention provides a golfer with a mechanism to easily and quickly adjust mass distribution properties of the club head to the golfer's specifications. For example, if the golfer would like to correct a hook or a slice, the golfer need only move the weight assembly to the corresponding second position, which effectively increases the golf club head's moment of inertia about a vertical axis (e.g., moving mass out towards the rear of the club head to increase moment of inertia about a vertical axis), which translates to a greater ability to resist twisting during off-center ball impacts and less of a distance penalty for those off-center ball impacts. If the golfer would like to obtain a greater distance on their shot, they need only reposition the weight assembly to the corresponding first position, which effectively lowers the center of gravity, while sacrificing a degree of the golf club head's moment of inertia.

Figure 19A:
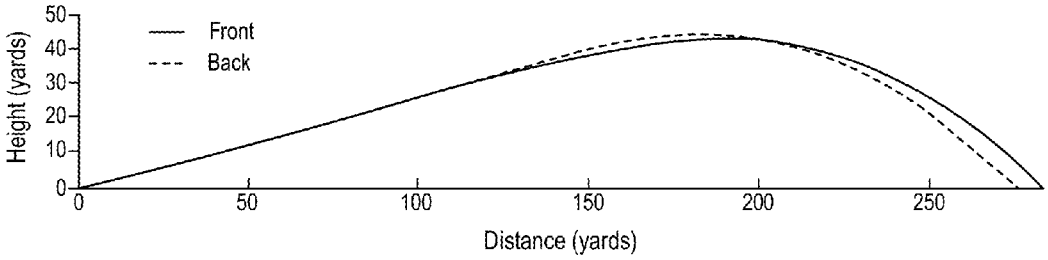
FIGS. 19A and 19B are plots of ball flight trajectory based on a position of a weight assembly along the length of the sole of the club head according to some embodiments.
Figure 19B:
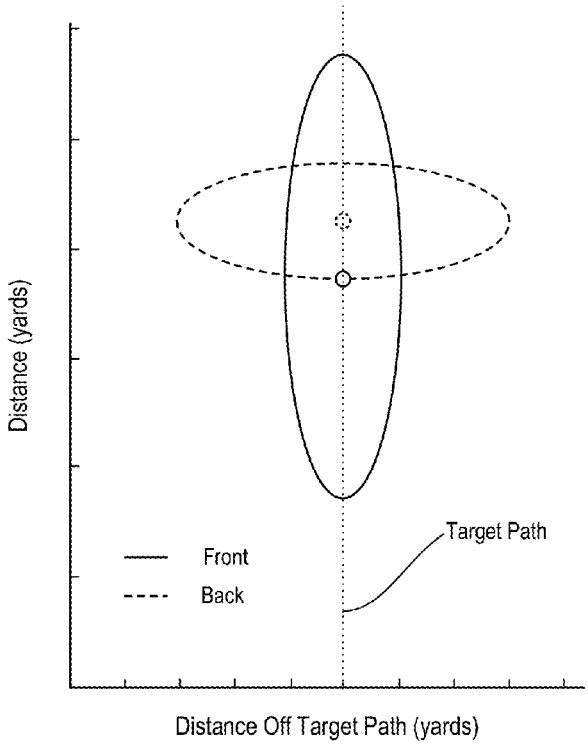

FIGS. 19A and 19B are plots of ball flight trajectory based on the position of the weight assembly 144 along the length of the sole 118 of the club head 102 according to some embodiments. The graph of FIG. 19A depicts flight trajectories based on placement of the weight assembly 144 in the first position (e.g., front) and the second position (e.g., back). As shown, placement of the weight assembly 144 in the first position resulted in a greater distance of ball flight compared to placement of the weight assembly 144 in the second position. The graph of FIG. 19B depicts a plot of landing zones associated with the first and second positions of the weight assembly 144. As shown, placement of the weight assembly 144 in the second position (e.g., back) resulted in a more accurate flight trajectory (less deviation from target path) and a greater average distance (represented by center point of plot) when compared with the flight trajectory associated with placement of the weight assembly 144 in the first position (e.g., front).

In some embodiments, one or more portions of the golf club head 102 may include markings or indicia representative of a performance characteristic associated with placement of the weight assembly in each of the first and second positions. For example, portions of the sole 118 adjacent to the first and second ends 128, 130 of the track may include markings indicating the performance characteristic provided by each position of the weight assembly 144, such as "distance" for the first position, and "accuracy" for the second position. Additionally, or alternatively, the weight assembly 144 may include similar markings. The markings or indicia may be in the form of a painting, engraving, embossing, decal, and combinations thereof.

Figure 20:
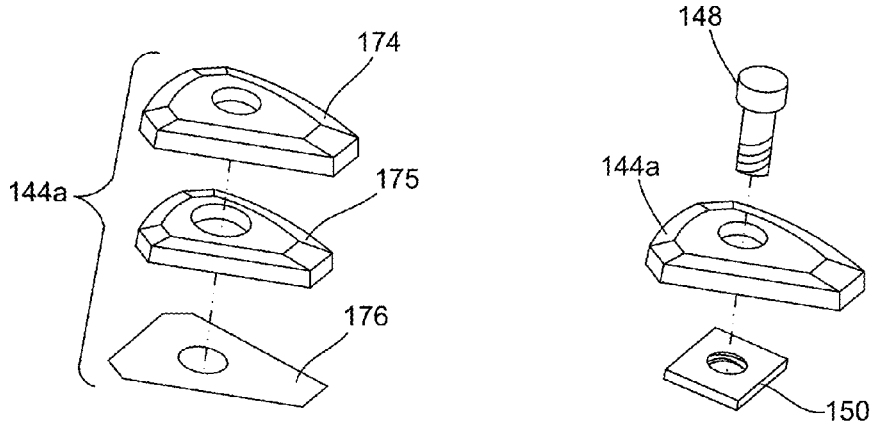
FIG. 20 is a perspective exploded view of a weight assembly according to some embodiments.
Figure 21:
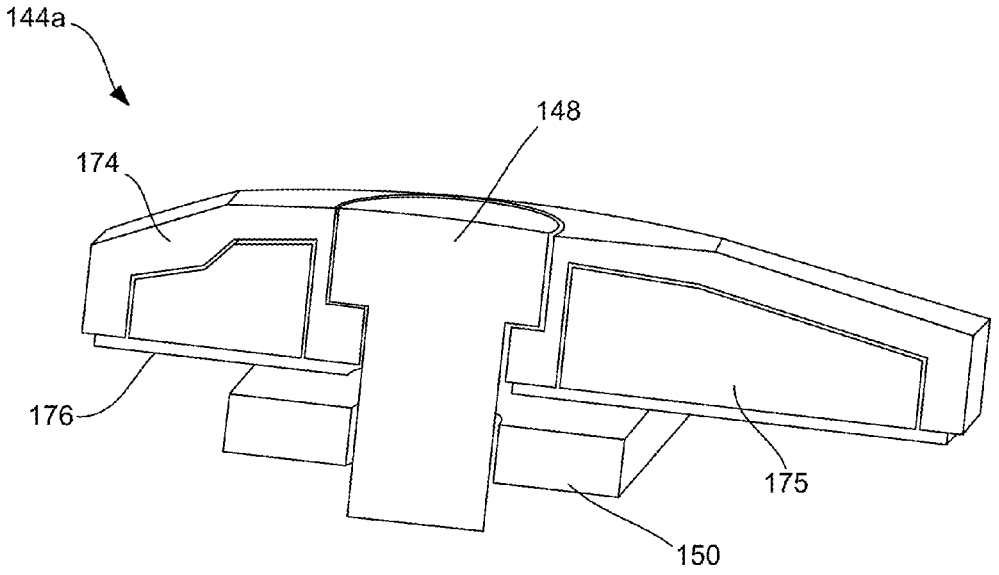
FIG. 21 is a perspective view, partly in section, of the weight assembly of FIG. 20 in an assembled state according to some embodiments.

FIG. 20 is a perspective exploded view of a weight assembly 144*a* according to some embodiments and FIG. 21 is a perspective view, partly in section, of a weight assembly in an assembled state according to some embodiments. As shown, the weight assembly 144*a* may include an outer cover 174, a main weight member 175 housed within a cavity of the outer cover 174, and a base member 176 enclosing the main weight member 175 within the cavity of the outer cover 174 and further coupling the main weight member 175 to the outer cover 176. The outer cover 174, main weight member 175, and base member 176 may each include a bore shaped and/or sized to receive the fastener 148 therethrough.

One or more components of the weight assembly 144*a* may be made of any suitable material, including metals, non-metallic materials, composites, ceramics, polymers, and the like. In some embodiments, at least one of the outer cover 174 and the main weight member 175 may be formed of carbon steel, stainless steel, carbon fiber, tungsten, tungsten loaded polymer, combinations of one or more of these materials, and the like. In some embodiments, at least one of the outer cover 174 and the main weight member 175 may be formed of a flexible material to allow some bending or flex. In other embodiments, at least one of the outer cover 174 and the main weight member 175 may be formed of stiffer materials. In some embodiments, the outer cover 174 may be formed of a metal material, such as aluminum or steel, and forged into the desired shape. In some embodiments, the main weight member 175 may be formed using molding techniques, such as injection molding.

Figure 22:
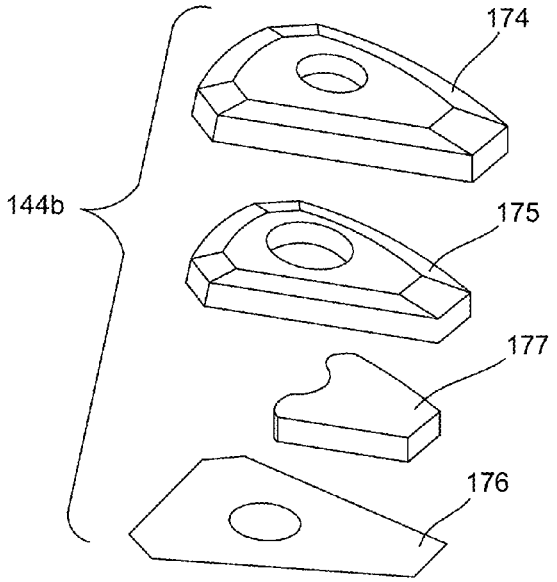
FIG. 22 is a perspective exploded view of a weight assembly according to some embodiments.
Figure 23:
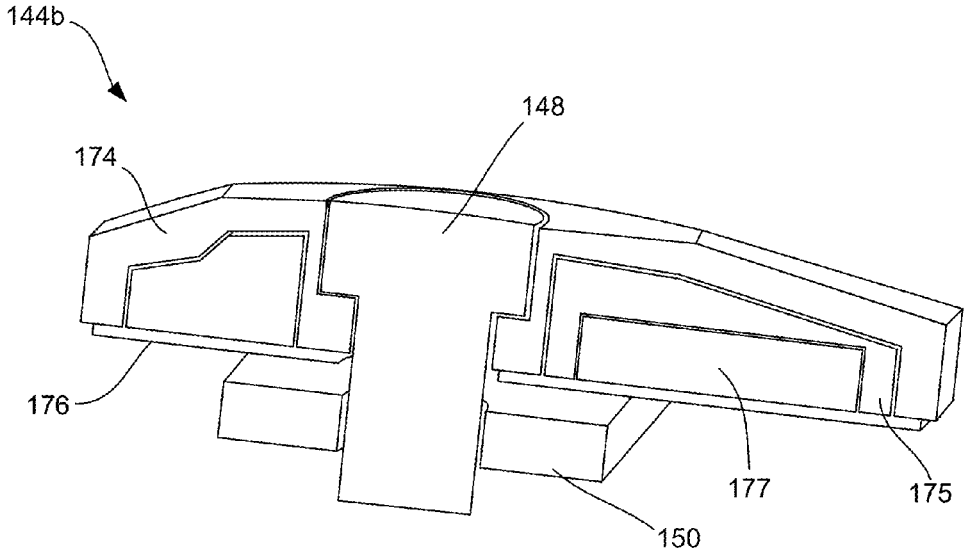
FIG. 23 is a perspective view, partly in section, of the weight assembly of FIG. 22 in an assembled state according to some embodiments.
Figure 24A:
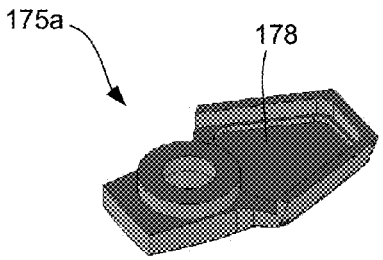
FIGS. 24A-24F are perspective views of various embodiments of the main weight member of the weight assembly of FIG. 22.
Figure 24B:
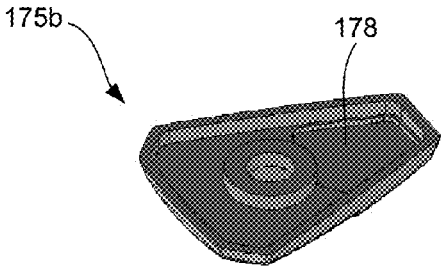
Figure 24C:
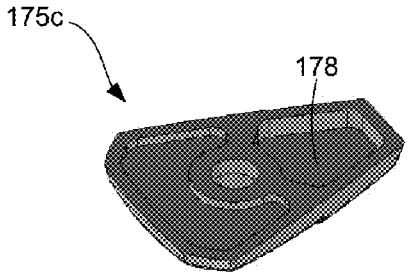
Figure 24D:
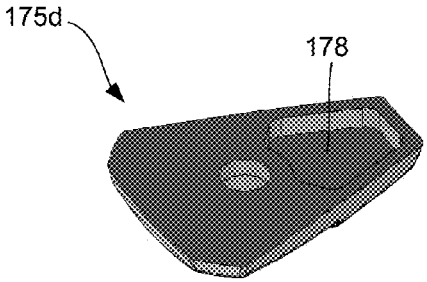
Figure 24E:
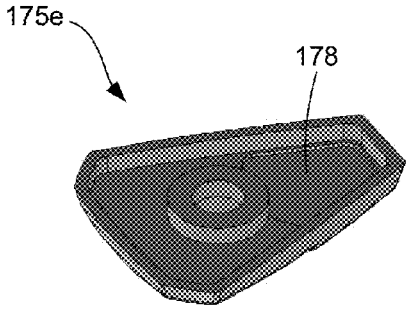
Figure 24F:
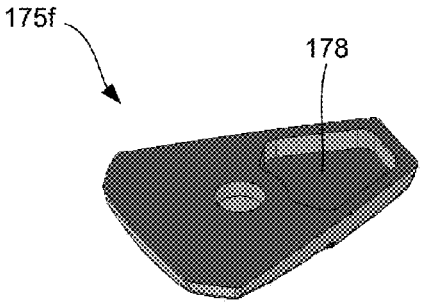

FIG. 22 is a perspective exploded view of another embodiment of a weight assembly 144*b* and FIG. 23 is a perspective view, partly in section, of the weight assembly 144*b* in an assembled state according to some embodiments. In the illustrated embodiment, a secondary weight member 177 may be housed within a cavity of the main weight member 175. The secondary weight member 177 may vary in density to allow for a range of weighting options in the assembled weight assembly 144*b*.

FIGS. 24A-24F are perspective bottom views of various embodiments of the main weight member 175 of the weight assembly 144*b*. As shown, each embodiment of the main weight member 175*a*-175*f* includes a cavity 178 shaped and/or sized to receive and enclose the secondary weight member 177 within. The embodiments of the main weight member 175*a*-175*f* each have a different shape, size, and/or configuration, which ultimately have an effect on the overall weight of the weight assembly 144*b*, thereby providing improved customization. For example, a golfer may have a kit of different weight assemblies 144 to use with the club head, wherein each weight assembly 144 has a different overall weight and/or weight distribution (e.g., front heavy, rear heavy, etc.).

The size and/or percentage of total mass of the golf club head associated with the weight assembly 144 may vary based on the desires of the player, skill level of the player, and the like. In some examples, the adjustable weight assembly 144 may comprise greater than 5% of the total mass of the golf club head 102. In other examples, the weight assembly 144 may comprise at least 10% of the mass of the golf club head 102. In still other examples, the mass associated with the weight assembly 144 may comprise at least 15% of the mass of the golf club head 102.

Figure 25:
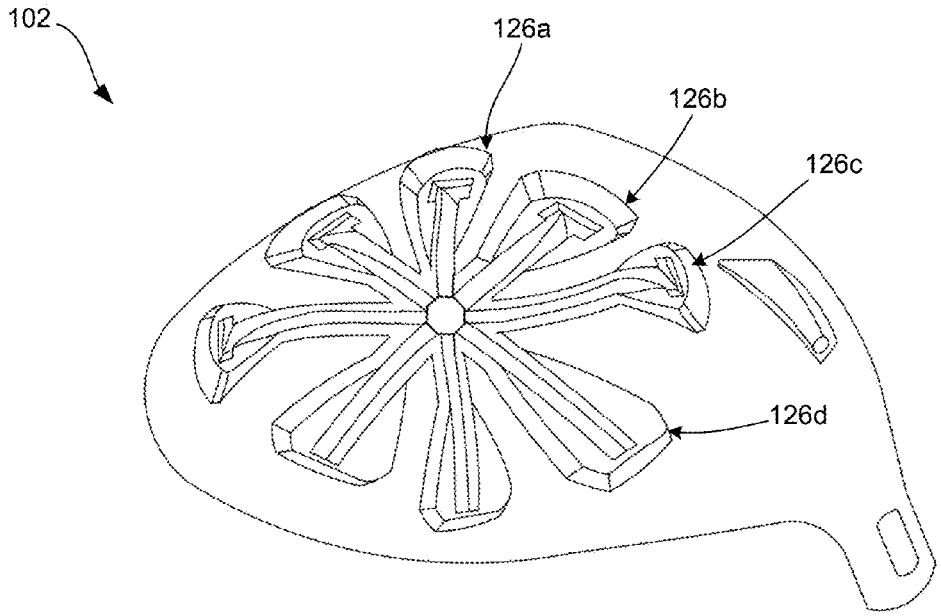
FIGS. 25 and 26 are perspective views of a golf club head illustrating a sole having different configurations of tracks formed thereon according to some embodiments.
Figure 26:
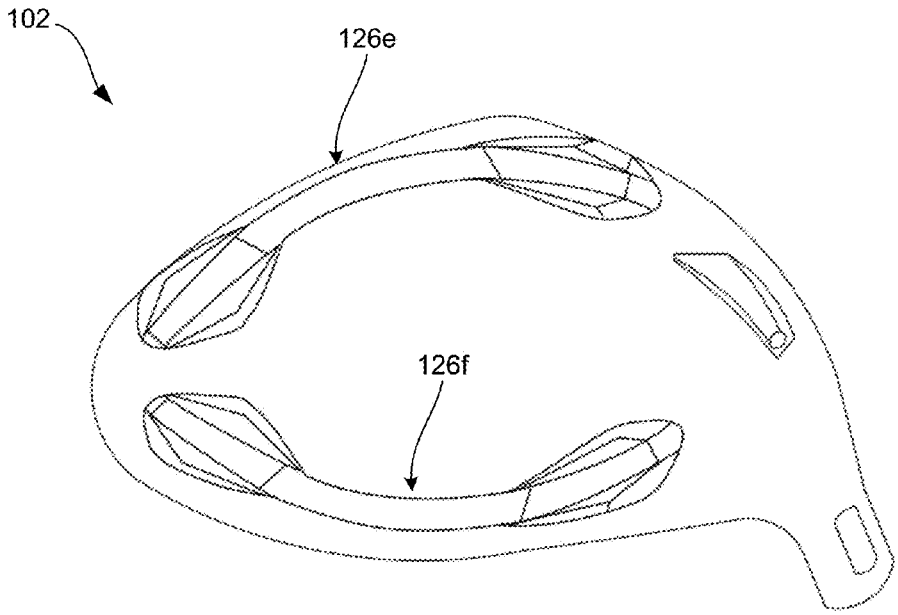

FIGS. 25 and 26 are perspective views of a golf club head 102 illustrating a sole having different configurations of tracks formed thereon according to some embodiments. For example, as shown in FIG. 25, the golf club head 102 includes at least four tracks 126*a*-126*d* formed on the sole of the club head. Each of the tracks 126*a*-126*d* is linear and has opposing ends for receiving a weight assembly therein. As shown, the tracks 126*a*-126*d* generally cross one another at a center point in the sole, such that a golfer has a multiple positions from which to choose from when adjusting the weight assembly 144. For example, a golfer member wish to move the weight assembly from the front portion of the club head 102, adjacent to the ball-striking face, to the toe portion of the club head. As such, the golfer need only move the weight towards the center point (where the tracks 126*a*-126*d* cross) and move from one track (e.g., track 126*b*) to another track (e.g., track 126*d*), and position the weight assembly accordingly. As shown in FIG. 26, the tracks 126*e*, 126*f* may be curvilinear and may extend along a length of the toe from the front portion to the rear portion (e.g., track 126*e*) and/or may extend along a length of the heel from the front portion to the rear portion (e.g., track 126*f*). Accordingly, a variety of different tracks may be formed along the sole of a club head consistent with the present disclosure, resulting in a variety of different positions in which to mount a weight assembly, thereby providing multiple performance characteristics from which a golfer may choose.

As previously described herein, a golf club head consistent with the present disclosure may include a multiple piece construction and structure, e.g., including one or more of a sole, a front face (optionally including a ball striking surface integrally formed therein or attached thereto), a top or crown, a rear, etc, as opposed to unitary, one-piece construction. Optionally, if desired, the various portions of the club head structure (such as the sole, the crown, the face, the rear, etc.) individually may be formed from multiple pieces of material without departing from this invention (e.g., a multi-piece crown, a multi-piece sole, etc.).

Figure 27A:
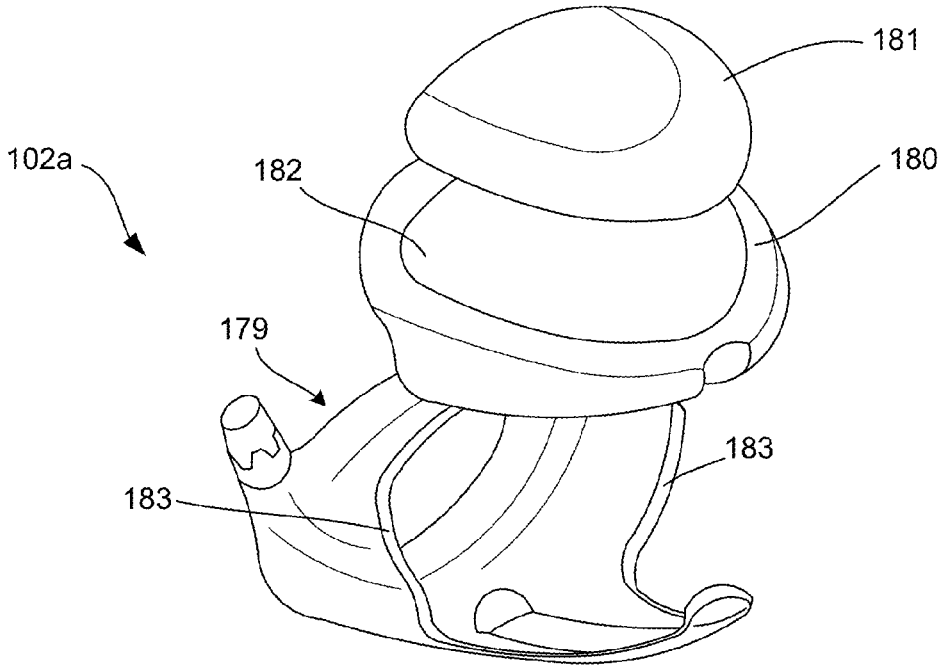
FIGS. 27A and 27B are perspective and rear exploded views, respectively, of a golf club head according to some embodiments.
Figure 27B:
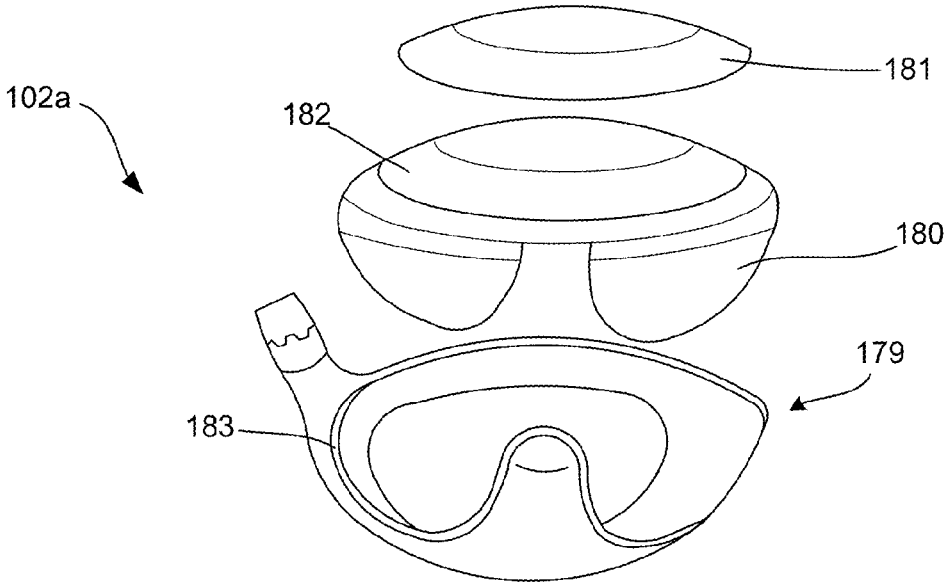

FIGS. 27A and 27B are perspective and rear exploded views, respectively, of a golf club head 102*a* according to one embodiment. As shown, club head 102*a* is of multi-piece construction, including a main body portion 179 forming the hosel, heel, toe, face, and sole of the club head 102*a*. The club head 102*a* further includes a first crown portion 180 and a second crown portion 181 shaped and/or sized to be received and secured to a recess 182 formed on a top surface of the first crown portion 180 by any known means (e.g., adhesive, welding, etc.). The main body portion 179 includes a ledge portion 183 extending along a periphery having an outline corresponding to the general shape and/or contour of the first crown portion 179. The first crown portion 180 is adapted to be coupled to the ledge portion by adhesives, cements, welding, soldering, or other bonding or finishing techniques, and the like. In this embodiment, the main body portion 179 comprises a titanium material, the first crown portion 180 comprises a carbon fiber material, and the second crown portion 181 comprises a VENOLLUM alloy material.

Figure 28A:
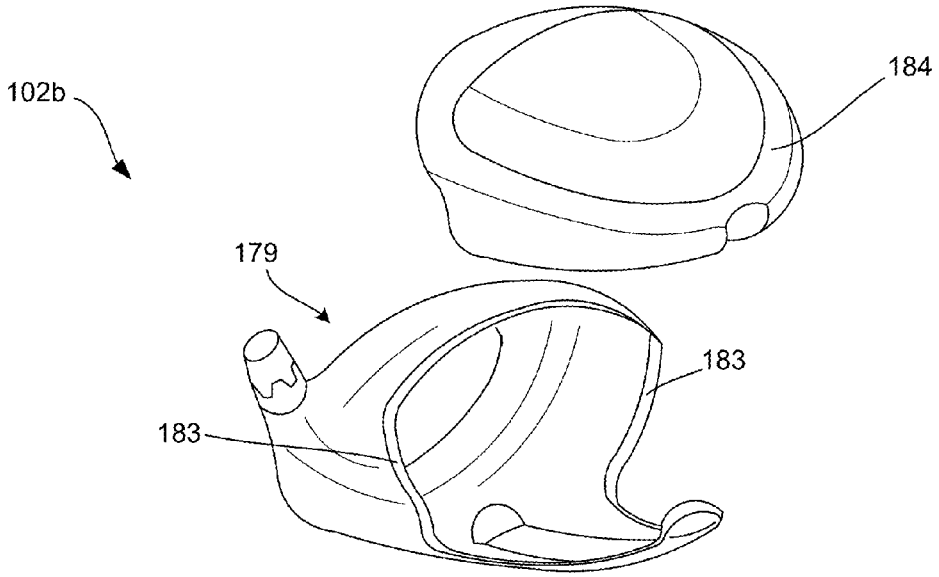
FIGS. 28A and 28B are perspective and rear exploded views, respectively, of a golf club head according to some embodiments.
Figure 28B:
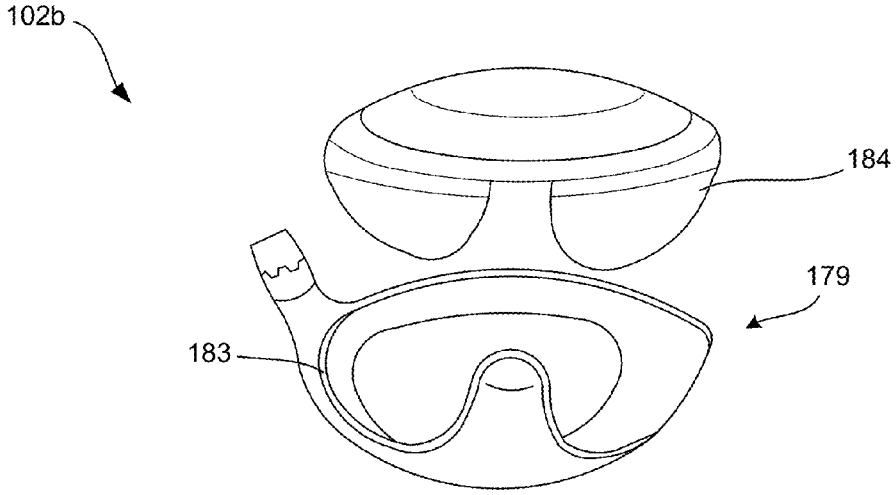

FIGS. 28A and 28B are perspective and rear exploded views, respectively, of a golf club head 102*b* according to another embodiment. This embodiment is similar to the club head 102*a* depicted in FIGS. 27A and 27B. However, this club head 102*b* includes a single crown portion 184 (as opposed to a two-part construction).

Figure 29A:
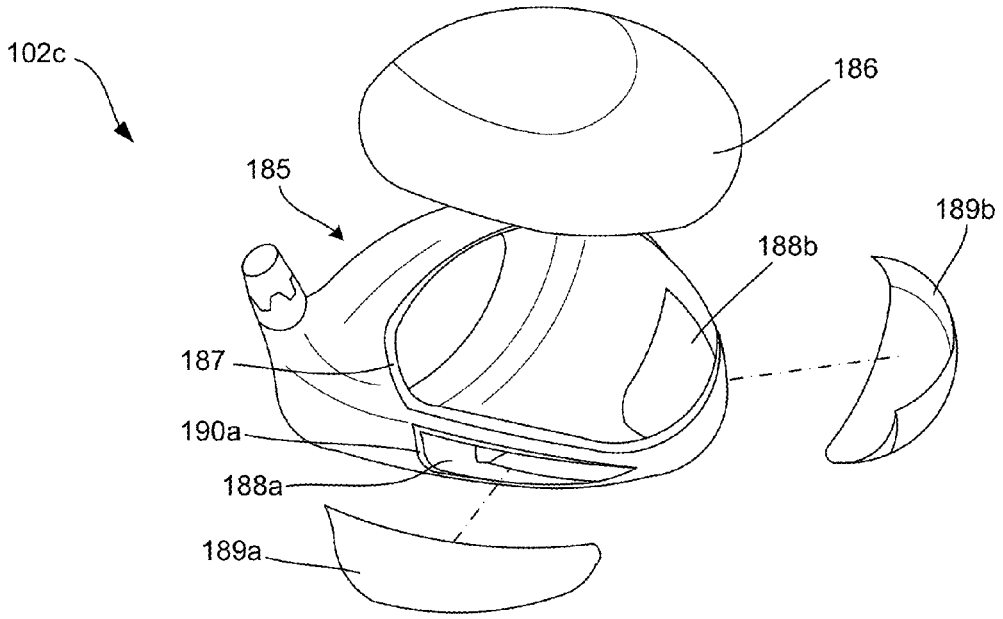
FIGS. 29A and 29B are perspective and rear exploded views, respectively, of a golf club head according to some embodiments.
Figure 29B:
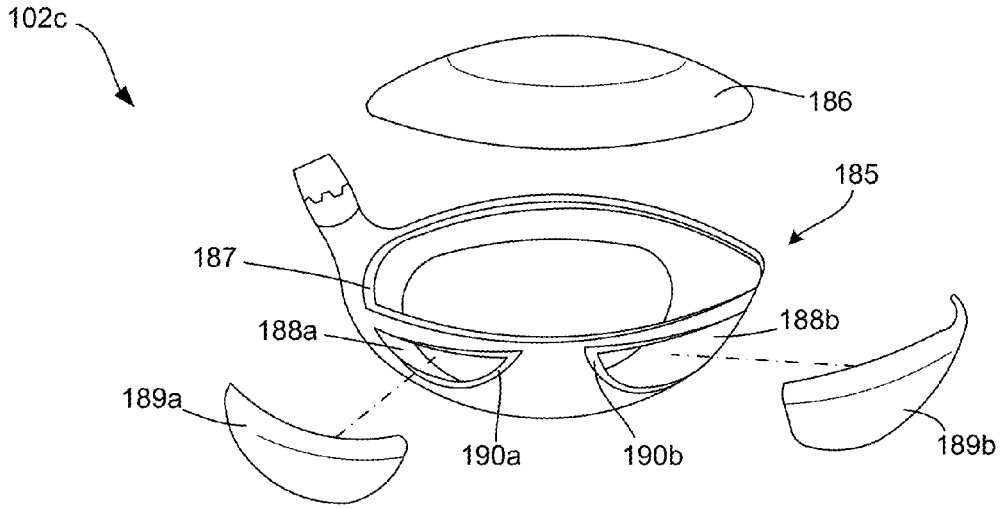

FIGS. 29A and 29B are perspective and rear exploded views, respectively, of a golf club head 102*c* according to yet another embodiment. As shown, club head 102*c* is of multi-piece construction, including a main body portion 185 forming the hosel, a portion of a heel, a portion of a toe, face, and sole of the club head 102*a*. The club head 102*a* further includes a crown portion 186 adapted to be received on and secured to a ledge portion 187 extending along a periphery of the main body portion 185 and having an outline corresponding to the general shape and/or contour of the crown portion 186. As shown, the main body portion 185 includes voids 188*a*, 188*b* in the heel and toe parts, wherein the voids 188*a*, 188*b* include ledge portions 190*a*, 190*b* extending along a periphery thereof, respectively. The club head 102*c* further includes a heel panel portion 189*a* adapted to be received on and secured to the ledge portion 190*a* of void 188*a* and a toe panel portion 189*b* adapted to be received on and secured to the ledge portion 190*b* of void 188*b*. In this embodiment, the main body portion 185 comprises a titanium material, the crown portion 184 comprises a carbon fiber material, and the heel panel portion 189*a* comprises a VENOLLUM alloy material and the toe panel portion 189*b* comprises a carbon fiber material.

Figure 30A:
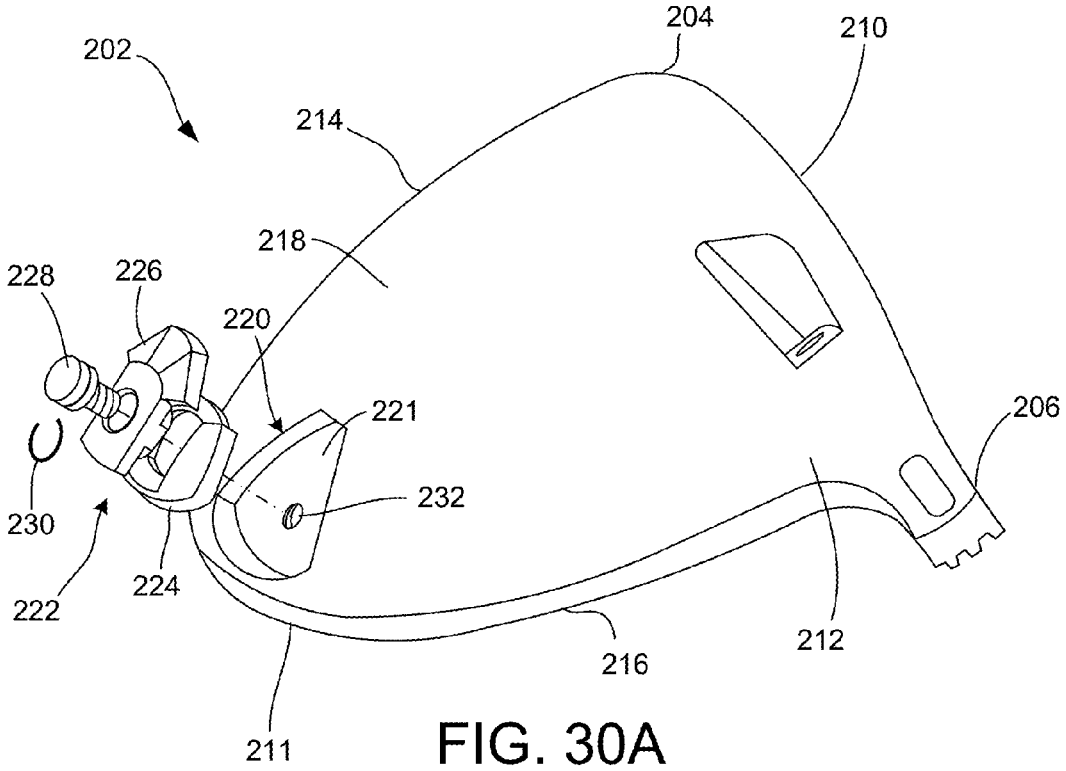
FIGS. 30A and 30B are perspective and side views of a golf club head illustrating a sole and a weight assembly couplable to the sole according to other embodiments.
Figure 30B:
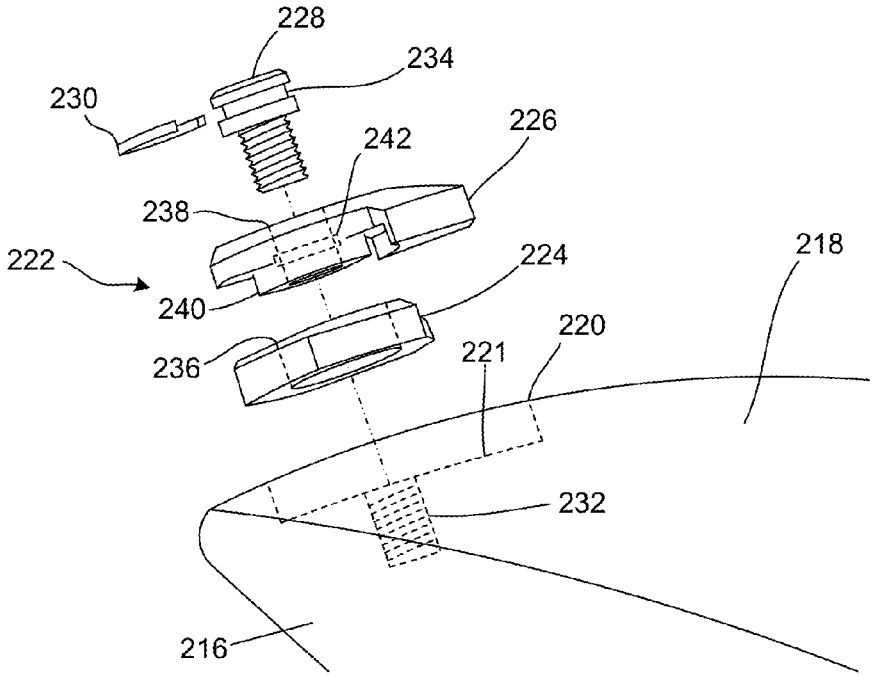

FIGS. 30A and 30B are perspective and side views, respectively, of a golf club head 202 illustrating a weight assembly 222 couplable to a weight mounting portion 220 on a sole 218 of the club head 202 according to other embodiments. As generally understood, the golf club head 202 has a club head body 204 having a hosel 206, a front portion 210, a rear portion 211, a heel 212, a toe 214, a crown 216, a sole 218, and a ball-striking face (not shown). As shown, at least one weight mounting portion 220 is formed on a portion of the sole 218. In the illustrated embodiment, the weight mounting portion 220 is formed adjacent the rear portion 211 of the club head 202. It should be noted, however, that in other embodiments, the weight mounting portion 220 may be formed on any portion of the sole 218 (e.g., adjacent the heel 212, adjacent the toe 214, adjacent the front portion 210, centered on sole 218, etc.). It should further be noted that according to other embodiments, the club head 202 may include more than a single weight mounting portion 220 (e.g., multiple weight mounting portions) formed on different portions of the sole 218. As shown, the weight mounting portion 220 is shaped and/or sized to receive a weight assembly 222 within and further includes a support surface 221 for supporting a weight assembly 222 once positioned within the mounting portion 220.

Figure 32A:
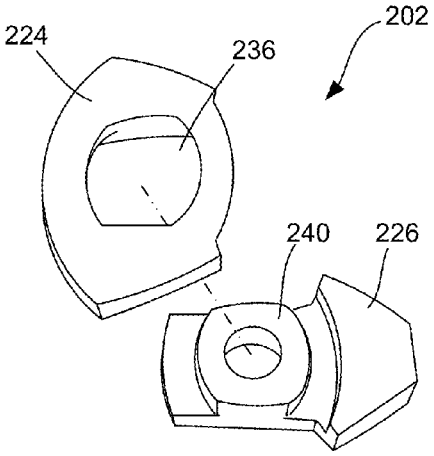
FIGS. 32A and 32B are perspective bottom views of the weight assembly of FIGS. 30A and 30B in disassembled and assembled states, respectively.
Figure 32B:
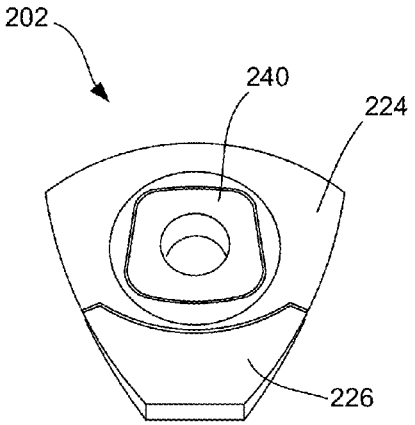

In one embodiment, the weight assembly 222 includes a base member 224 and a weight insert 226, wherein the base member 224 and weight insert 226 are shaped and/or sized to mate with one another and form a single weight assembly 222 (shown in FIG. 32B). The weight assembly 222 is coupled to the sole 118, specifically the weight mounting portion 220, by way of an elongate mechanical fastener 228 extending through a portion of the weight assembly 222 and engaging a threaded aperture 232 defined on the support surface 221 of the weight mounting portion 220. In the illustrated embodiment, the base member 224 includes a bore 236 shaped and/or sized to receive a protrusion 240 of the weight insert 226 (thereby coupling the insert 226 and base member 224 to one another) and further to receive the fastener 228 therethrough. The weight insert 226 also includes a bore 238 shaped and/or sized to receive the fastener therethrough when in axial alignment with the bore 236 of the base member 224.

As shown, the fastener 228 includes external threading configured to engage the internally threaded bore 232 of the weight mounting portion 220. The fastener 228 further includes a channel 234 defined along a portion of the head. The channel 234 is shaped and/or sized to receive a retaining element 230 (e.g., spring clip) within. The weight insert 226 also includes a channel 242 formed along an inner surface of the bore 238, such that, when the fastener 228 is positioned within the weight assembly 222 in an assembled state, the spring clip 230 is positioned and retained between the channels 234, 242.

Figure 31A:
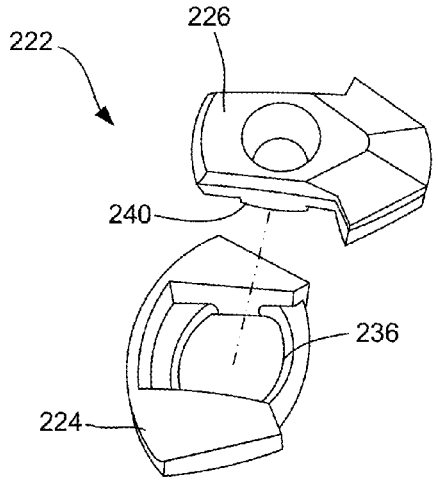
FIGS. 31A and 31B are perspective top views of the weight assembly of FIGS. 30A and 30B in disassembled and assembled states, respectively.
Figure 31B:
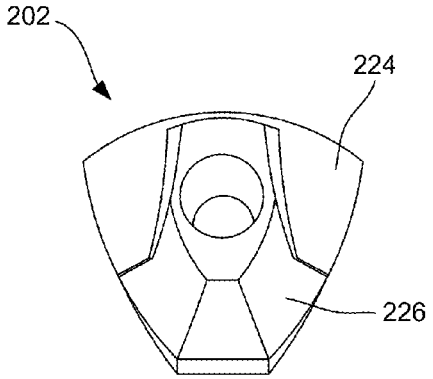

FIGS. 31A and 31B are perspective top views of the weight assembly 222 in disassembled and assembled states, respectively. FIGS. 32A and 32B are perspective bottom views of the weight assembly 222 in disassembled and assembled states, respectively. As shown, the weight insert 226 correspondingly mates with the base member 224 to form a single weight assembly 222. In particular, the weight insert 226 includes a protrusion 240 shaped and/or sized to fit within the bore 236 of the base member 224, such that the weight insert 226 correspondingly engages the base member 224. In one embodiment, the base member 224 and weight insert 226 may be secured to one another via press-fit, bonding with adhesives or cements, welding (e.g., laser welding), soldering, brazing, or other fusing techniques, etc. In other embodiments, the base member 224 and weight insert 226 may be loosely coupled to one another (e.g., coupled to one another by way of the fastener 228 engaged with the threaded bore 232), such that, once the fastener is removed from the bore 232, the weight assembly 222 can be disassembled to exchange different weight inserts and/or base members. In some embodiments, at least one of the base member 224 and the weight insert 226 may be formed of a metal material, such as aluminum, steel, tungsten, or combinations thereof and forged into the desired shape. In some embodiments, the weight insert 226 may be formed using molding techniques, such as injection molding.

Figure 33:
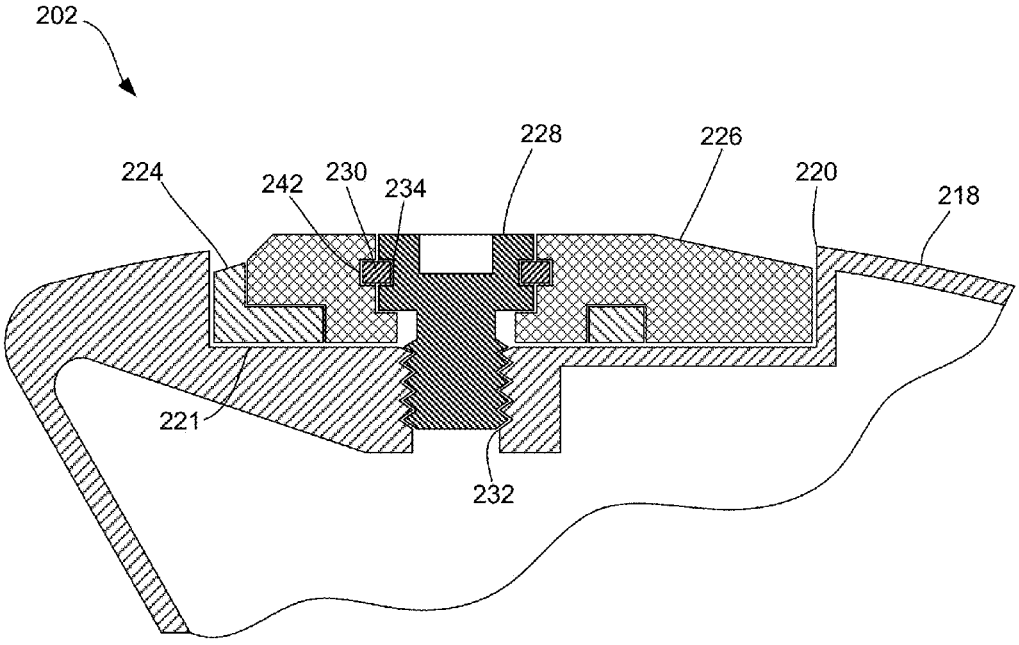
FIG. 33 is a sectional view of the club head of FIG. 30A illustrating the weight assembly securely coupled to a mounting portion of the sole.

FIG. 33 is a sectional view of the club head of FIG. 30A illustrating the weight assembly 220 securely coupled to the weight mounting portion 220 of the sole 218. As shown, the weight insert 226 correspondingly mates with the base member 224 to form a single weight assembly 222. In one embodiment, the base member 224 and weight insert 226 may be secured to one another via press-fit, bonding with adhesives or cements, welding (e.g., laser welding), soldering, brazing, or other fusing techniques, etc. In other embodiments, the base member 224 and weight insert 226 may be loosely coupled to one another (e.g., coupled to one another by way of the fastener 228 engaged with the threaded bore 232), such that, once the fastener is removed from the bore 232, the weight assembly 222 can be disassembled to exchange different weight inserts and/or base members.

The weight assembly 222 is securely coupled to the weight mounting portion 220 by way of the fastener 228 engaging the internally threaded bore 232 formed on the support surface 221 of the weight mounting portion 220. As shown, the channel 234 defined on the head portion of the fastener 228 generally aligns with the channel 242 formed along the inner surface of the bore 238 of the weight insert 226, such that the spring clip 230 is retained between the channels 234, 242. The spring clip 230 is adapted to maintain engagement of the fastener 228 at least the weight insert 226. The spring clip 230 allows rotation of the fastener 228, while preventing separation of the fastener 228 from the weight insert 226, thereby ensuring that at least the weight insert 226 remains coupled to the fastener when a golfer is removing the weight assembly 222 from the weight mounting portion 220, thereby reducing the opportunity to misplace or lose components. As shown, the weight mounting portion 220 has a shape corresponding to a shape and/or contour of the weight assembly 222. In some embodiments, the weight mounting portion 220 may be shaped and/or sized to receive the entire weight assembly 222 within. In some embodiments, the weight assembly 222 may rest below an exterior surface of the sole 218 when secured to the weight mounting portion 220, such that the weight assembly 222 does not protrude from the sole 218 of the club head.

The performance characteristics of a golf club can be customized based on placement of the weight assembly 222 to one or more regions of the club head in order to adjust a center of gravity, mass moment of inertia, and/or swingweight of the club head. For example, a club head 202 may have multiple weight mounting portions 220 positioned along the sole 218 of the club head. In one embodiment, the club head 202 may include at least two weight mounting portions on the sole 218, including a first weight mounting portion adjacent the rear portion 211 of the club head 202 and a second weight mounting portion adjacent the front portion 210 of the club head 202 (e.g., in a similar configuration as club head 102 shown in FIGS. 4 and 5). The mass distribution of the golf club head 202 can be changed based on different positions of the weight assembly 222, such that placement of the weight assembly 222 in the first weight mounting portion adjacent to the rear portion 211 of the club head 202 may provide different performance characteristics than placement of the weight assembly 222 in the second weight mounting portion adjacent to the front portion 210 of the club head. For example, when the weight assembly 222 is placed within the first weight mounting assembly at the rear 211, the golf club head 202 has a center of gravity that is lower than when the weight assembly 222 is placed within the second weight mounting assembly at the front 210. Additionally, when the weight assembly 222 is placed within the second weight assembly at the front 210, the golf club head 202 has a moment of inertia that is greater than when the weight assembly 222 is placed within the first weight mounting assembly. It should be noted that the club head 202 can have any number of weight mounting portions formed on any portion thereof (e.g., sole, crown, heel, toe, etc.) and in any particular pattern.

Additionally, one or more portions of the golf club head body 202 may include markings or indicia representative of a performance characteristic associated with placement of the weight assembly in any particular weight mounting portion, thus providing a golfer with a clear indication of the performance of the club. For example, a portion of the sole 218 adjacent to a weight mounting portion may include markings indicating the performance characteristic provided by placement of the weight assembly 222 within the particular weight mounting portion, such as "distance" for placement of the weight assembly 222 in the weight mounting portion adjacent the front 210 of the club head, and "accuracy" for placement of the weight assembly 222 within the weight mounting portion adjacent the rear 211 of the club head. The markings or indicia may be in the form of a painting, engraving, embossing, decal, and combinations thereof.

Figure 34:
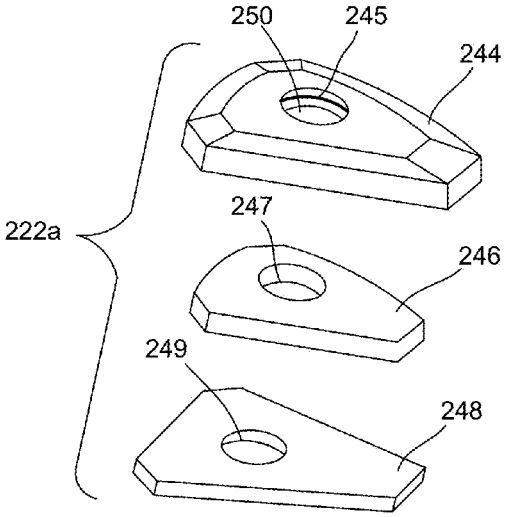
FIG. 34 is a perspective exploded view of a weight assembly according to some embodiments.
Figure 35:
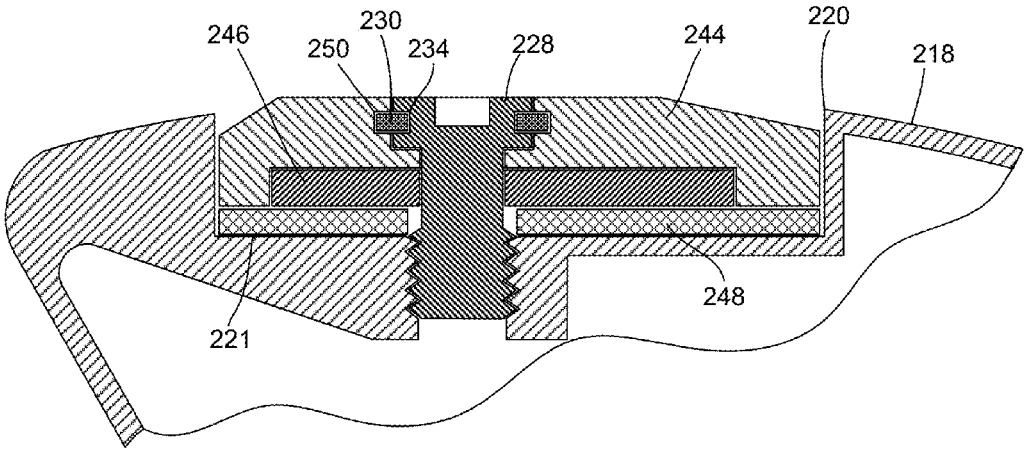
FIG. 35 is a sectional view of the club head of FIG. 30A illustrating the weight assembly of FIG. 34 securely coupled to a mounting portion of the sole.

FIG. 34 is a perspective exploded view of another embodiment of a weight assembly 222*a* and FIG. 35 is a sectional view of the club head of FIG. 30A illustrating the weight assembly 222*a* securely coupled to the weight mounting portion 220. As shown, the weight assembly 222*a* may include an outer cover 244, a weight member 246 housed within a cavity of the outer cover 244, and a support member 248 enclosing the weight member 246 within the cavity of the outer cover 244 and further coupling the weight member 246 to the outer cover 244. As shown, the outer cover 244, weight member 246, and support member 248 each include a bore 245, 247, 249, respectively, shaped and/or sized to receive the fastener 228 therethrough. Additionally, a channel 250 is defined along an inner surface of the bore 245 of the outer cover 244. The channel 250 is shaped and/or sized to receive the spring clip 230, such that, when the fastener 228 is positioned within the weight assembly 222*a* in an assembled state (shown in FIG. 35), the spring clip 230 is positioned and retained between the channels 250, 242, thereby securing the fastener 228 to the weight assembly 222*a*.

The outer cover 244 and weight member 246 may be secured to one another via press-fit, bonding with adhesives or cements, welding (e.g., laser welding), soldering, brazing, or other fusing techniques, etc., such that they are fixed to one another. The support member 248 may be formed from a foam or other supportive material and may be secured to the base of the weight member 246 and outer cover 244 by way of adhesive. The support member 248 may be adapted to provide a supportive interface between the weight assembly 222*a* and the weight mounting portion 220 and further dissipate and/or manage vibration, rattling, and/or sound.

It should be noted that all embodiments of a weight assembly consistent with the present disclosure may be coupled to the fastener by way of a retaining element (e.g., spring clip), as shown in FIGS. 30A-30B and 33-35 and described herein. For example, the weight assembly 144, shown in at least FIGS. 8-18, may be coupled to the fastener 148 by way of the spring clip 230. In particular, the bore 146 of the weight assembly 144 may include a channel formed along an inner wall and a corresponding channel may be formed on an outer surface of the head of the fastener 148, wherein each of the channels is shaped and/or sized to receive a portion of the spring clip 130 within. The spring clip may first be placed in either of the channels prior to insertion of the head of the fastener 148 within the bore 146 of the weight assembly 146. Accordingly, upon insertion of the head of the fastener 148 into the bore 146 of the weight assembly 144, the spring clip is received within the channels of the bore 146 and the head of the fastener 148, thereby coupling the weight assembly 144 to the fastener 148, while still allowing rotation of the fastener 148.

While several embodiments of the present disclosure have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present disclosure. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present disclosure is/are used.

Those skilled in the art will recognize, or be able to ascertain using no more than routine experimentation, many equivalents to the specific embodiments of the disclosure described herein. It is, therefore, to be understood that the foregoing embodiments are presented by way of example only and that, within the scope of the appended claims and equivalents thereto, the disclosure may be practiced otherwise than as specifically described and claimed. The present disclosure is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

Reference throughout this specification to "one embodiment" or "an embodiment" means that a particular feature, structure, or characteristic described in connection with the embodiment is included in at least one embodiment. Thus, appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents.

Incorporation By Reference

References and citations to other documents, such as patents, patent applications, patent publications, journals, books, papers, web contents, have been made throughout this disclosure. All such documents are hereby incorporated herein by reference in their entirety for all purposes.

Equivalents

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

What is claimed is:

1. A golf club head comprising:

a club head body comprising a front portion, a rear portion, a ball-striking face at the front portion of the club head body, a heel, a toe, a crown, and a sole;

a track formed along a length of the sole of the club head body, the track has at least a first end and an opposing second end adjacent to the front and rear portions of the club head body, respectively, wherein the track comprises a channel extending from an exterior surface of the sole towards an internal cavity of the club head body, the channel lies along a plane that extends generally from the sole to the crown of the club head body, the channel has a groove formed therein extending along length of the channel, wherein the groove lies along a plane that extends generally from the heel to the toe of the club head body;

a weight assembly coupled to a portion of the track by way of an externally threaded headed fastener extending through a portion of the weight assembly, into the channel, and engaging an internally threaded retaining member retained within the groove of the channel, wherein the weight assembly is adapted to move along a length of the track between at least a first position and a second position; and a spring element coupled to the fastener and positioned between the weight assembly and the retaining member, the spring element adapted to apply a biasing force against at least the weight assembly.

2. The golf club head of claim 1, wherein the weight assembly remains coupled to the club head body in any position along the length of the track.

3. The golf club head of claim 1, wherein, when in the first position, the weight assembly is secured to the first end of the track, and when in the second position, the weight assembly is secured to the second end of the track.

4. The golf club head of claim 1, wherein the externally threaded headed fastener is a bolt and the corresponding retaining member is a square nut.

5. The golf club head of claim 1, wherein the groove is shaped and/or sized to prevent rotation of the retaining member therein and further allow the retaining member to translate along a length of the groove in conjunction with associated movement of the weight assembly between the first and second positions.

6. The golf club head of claim 1, further comprising a retaining clip coupled to a distal end of the fastener and adapted to allow the fastener to rotate while limiting movement of the retaining member along a defined length of the fastener.

7. The golf club head of claim 1, wherein the first end and the second end of the track each define a recess shaped and/or sized to receive the weight assembly therein and each have a support surface for supporting the weight assembly.

8. The golf club head of claim 7, wherein the mechanical fastener is adapted to secure the weight assembly against the support surfaces of the first and second ends when the weight assembly is in the first and second positions, respectively.

9. The golf club head of claim 1, wherein, when the weight assembly is in the first position, the golf club head has a center of gravity that is lower than when the weight assembly is in the second position.

10. The golf club head of claim 1, wherein, when the weight assembly is in the second position, the golf club head has a moment of inertia that is greater than when the weight assembly is in the first position.

11. The golf club head of claim 1, wherein at least a portion of the sole has indicia representative of a performance characteristic associated with placement of the weight assembly in each of the first and second positions.

* * * * *